US009012119B2

(12) United States Patent
Mori et al.

(10) Patent No.: US 9,012,119 B2
(45) **Date of Patent: *Apr. 21, 2015**

(54) LIQUID DEVELOPER, IMAGE FORMING APPARATUS, IMAGE FORMING METHOD, LIQUID DEVELOPER CARTRIDGE, AND PROCESS CARTRIDGE

(71) Applicant: Fuji Xerox Co., Ltd., Tokyo (JP)

(72) Inventors: Keitaro Mori, Kanagawa (JP); Satoshi Tatsuura, Kanagawa (JP); Yutaka Nogami, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/013,325

(22) Filed: Aug. 29, 2013

(65) Prior Publication Data

US 2014/0287356 A1 Sep. 25, 2014

(30) Foreign Application Priority Data

Mar. 25, 2013 (JP) ..... 2013-062596

(51) Int. Cl.
*G03G 9/13* (2006.01)
*G03G 9/135* (2006.01)
*G03G 9/125* (2006.01)
*G03G 15/16* (2006.01)

(52) U.S. Cl.
CPC ..... *G03G 9/132* (2013.01); *G03G 9/1355* (2013.01); *G03G 9/131* (2013.01); *G03G 15/1605* (2013.01); *G03G 9/125* (2013.01)

(58) Field of Classification Search
CPC ..... G03G 9/131; G03G 9/1355
USPC ..... 430/114, 115, 116, 117.4; 399/233
See application file for complete search history.

(56) References Cited

U.S. PATENT DOCUMENTS

2013/0209933 A1* 8/2013 Sato ..... 430/115

FOREIGN PATENT DOCUMENTS

JP A-2004-205843 7/2004
JP A-2008-77026 4/2008

* cited by examiner

*Primary Examiner* — Mark A Chapman
(74) *Attorney, Agent, or Firm* — Oliff PLC

(57) ABSTRACT

A liquid developer includes a toner that contains a binder resin and a release agent, and a carrier liquid that has a difference (ΔSP (tc)) in SP value from the binder resin of from 1.5 to 7.0, wherein the release agent is not eluted in the carrier liquid at a temperature lower than a glass transition temperature of the binder resin.

11 Claims, 2 Drawing Sheets

LIQUID DEVELOPER, IMAGE FORMING APPARATUS, IMAGE FORMING METHOD, LIQUID DEVELOPER CARTRIDGE, AND PROCESS CARTRIDGE

CROSS-REFERENCE TO RELATED APPLICATIONS

This application is based on and claims priority under 35 USC 119 from Japanese Patent Application No. 2013-062596 filed Mar. 25, 2013.

BACKGROUND

1. Technical Field

The present invention relates to a liquid developer, an image forming apparatus, an image forming method, a liquid developer cartridge, and a process cartridge.

2. Related Art

Electrophotographic image forming apparatuses and image forming methods using, as a developer, a liquid developer in which a toner is dispersed in a carrier liquid have been known.

SUMMARY

According to an aspect of the invention, there is provided a liquid developer including: a toner that contains a binder resin and a release agent; and a carrier liquid that has a difference (ΔSP (tc)) in SP value from the binder resin of from 1.5 to 7.0, wherein the release agent is not eluted in the carrier liquid at a temperature lower than a glass transition temperature of the binder resin.

BRIEF DESCRIPTION OF THE DRAWINGS

Exemplary embodiments of the present invention will be described in detail based on the following figures, wherein.

DETAILED DESCRIPTION

Figure 1:
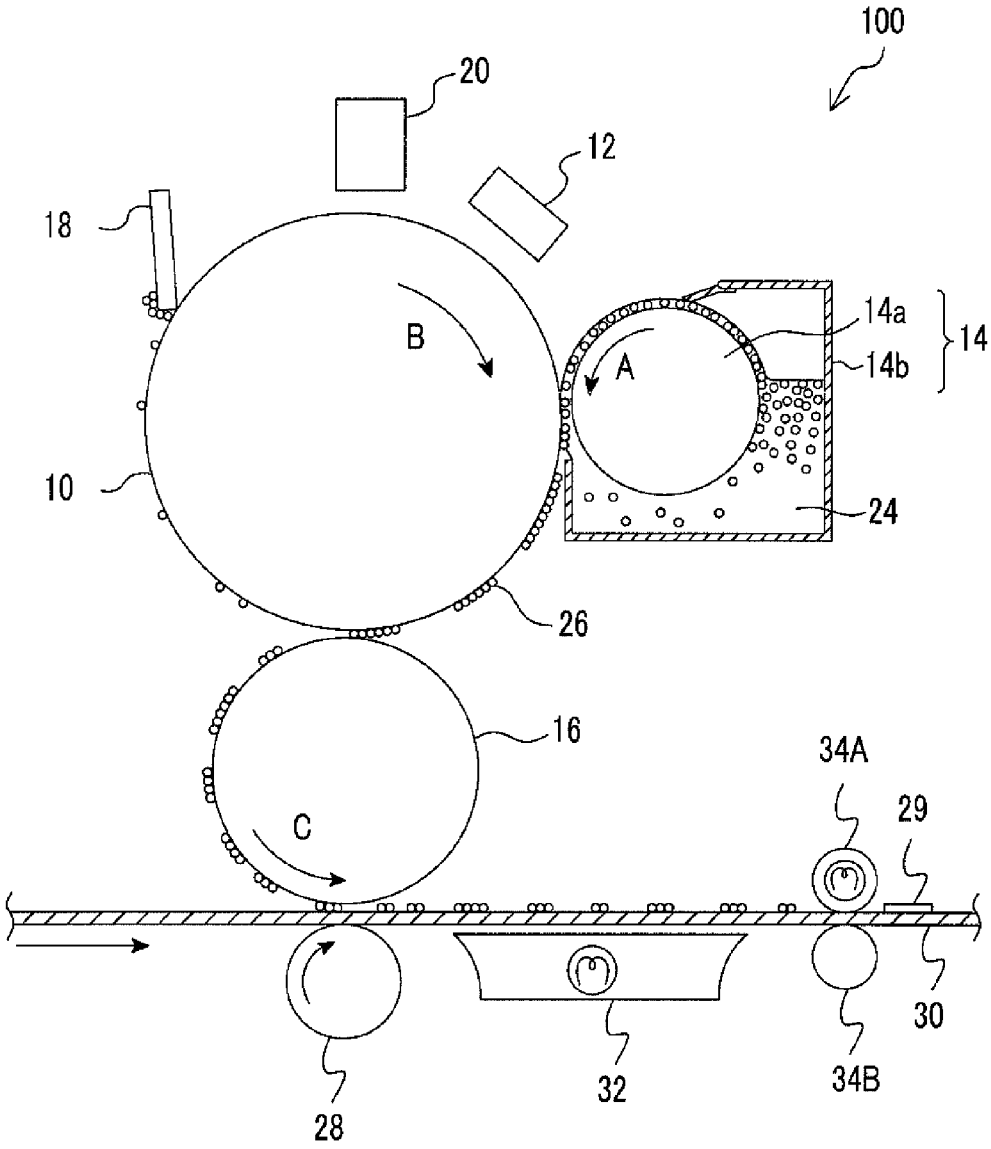
FIG. 1 is a schematic diagram showing a configuration of an example of an image forming apparatus of an exemplary embodiment.

Hereinafter, exemplary embodiments of a liquid developer, an image forming apparatus, an image forming method, a liquid developer cartridge, and a process cartridge of the invention will be described in detail.

A liquid developer according to an exemplary embodiment contains a toner and a carrier liquid.

The toner contains a binder resin and a release agent. The release agent is not eluted in the carrier liquid at a temperature that is lower than the glass transition temperature of the binder resin.

A difference (ΔSP (tc): absolute value) between SP values (solubility parameters) of the binder resin and the carrier liquid is from 1.5 to 7.0.

Here, the glass transition temperature of the binder resin is measured according to ASTMD3418-8 by means of a DSC measuring device (differential scanning calorimeter DSC-7, manufactured by Perkin Elmer Co., Ltd.). In order to correct the temperature of a detector of the device, melting temperatures of indium and zinc are used, and in order to correct calorie, heat of fusion of indium is used. A pan made of aluminum is used as a sample, an empty pan is set for comparison, and a value obtained by performing the measurement at a rate of temperature increase of 10° C./min is employed.

Since the liquid developer according to this exemplary embodiment has the above-described configuration, document offset (a phenomenon in which a fixed image is transferred to another recording medium or to a fixed image formed on another recording medium) is suppressed from occurring under an environment of a temperature lower than the glass transition temperature of the binder resin of the toner.

The reason for this is not clear, but is thought to be as follows.

First, since the liquid developer contains a toner and a carrier liquid, the carrier liquid remains in a fixed image formed by using the liquid developer. Therefore, when affinity between the binder resin and the carrier liquid contained in the toner is too high, the fixed image (binder resin constituting the fixed image) may be softened even at a temperature lower than the glass transition temperature of the binder resin. It is thought that the reason for this is that in the fixed image, the binder resin constituting the fixed image and the remaining carrier liquid interact with each other, and thus the apparent glass transition temperature of the binder resin is reduced. In addition, the interaction may cause document offset even under an environment of a temperature lower than the glass transition temperature of the binder resin of the toner.

On the other hand, when the affinity between the binder resin and the carrier liquid contained in the toner is reduced, that is, when the difference between the SP values of the binder resin and the carrier liquid is increased in the above range, the interaction between the binder resin constituting the fixed image and the remaining carrier liquid is generated less in the fixed image, and thus it is thought that the reduction in the apparent glass transition temperature of the binder resin is suppressed.

When the affinity between the binder resin and the carrier liquid contained in the toner is excessively reduced, that is, when the difference between the SP values of the binder resin and the carrier liquid is excessively increased beyond the above range, the toner is not dispersed, but separated in the carrier liquid.

When a release agent is contained in the toner, a release layer formed of a release agent is formed on the surface of the fixed image. When the release agent has such a property as to be eluted in the carrier liquid at a temperature lower than the glass transition temperature of the binder resin, the release layer of the fixed image may be softened even at a temperature lower than the glass transition temperature of the binder resin. It is thought that the reason for this is that the carrier liquid remaining in the fixed image is easily transferred to the release layer. When the fixed image is subjected to a load in a state in which the release layer is softened, the thickness of the release layer on the surface of the fixed image is reduced and the fixed image may be exposed. That is, when recording mediums on which a fixed image is formed overlap each other and the fixed images are subjected to a load, the fixed image is partially brought into direct contact with another recording medium (or fixed image formed thereon). Due to the exposure of the fixed image, document offset may occur even under an environment of a temperature lower than the glass transition temperature of the binder resin of the toner.

On the other hand, when a release agent that is not eluted in a carrier liquid at a temperature lower than the glass transition temperature of the binder resin is applied as the release agent contained in the toner, the carrier liquid remaining in the fixed image is difficult to transfer to the release layer, and it is thought that the release layer of the fixed image is suppressed from being softened at a temperature lower than the glass transition temperature of the binder resin.

From the above description, it is thought that with the liquid developer according to this exemplary embodiment, document offset is suppressed under an environment of a temperature lower than the glass transition temperature of the binder resin of the toner.

Here, the difference (ΔSP (tc)) between the SP values of the binder resin and the carrier liquid of the toner is from 1.5 to 7.0, preferably from 1.5 to 6, and more preferably from 1.7 to 5.7.

When ΔSP (tc) is less than 1.5, document offset occurs. When ΔSP (tc) is greater than 7.0, toner dispersibility in the carrier liquid is reduced.

In addition, ΔSP (tc) is preferably from 1.5 to 3.0 from the viewpoint of suppressing toner dispersibility in the carrier liquid and document offset.

ΔSP (tc) is preferably from greater than 3.0 to 7.0 from the viewpoint of more suppressing document offset.

The SP value of the binder resin of the toner is a SP value of an amorphous resin that is used as a major component of the binder resin. In addition, when two or more types of amorphous resins are used in combination, the SP value of the binder resin of the toner is an average value of the SP values of the respective amorphous resins.

When two or more types of carrier liquids are used in combination, the SP value of the carrier liquid is an average value of the SP values of the respective carrier liquids.

Next, a SP value calculation method will be described. The SP value is a square root of a density of cohesive energy. In this exemplary embodiment, the SP value of the binder resin of the toner and the SP value of the carrier liquid are calculated by the following method.

In the SP value calculation method, a SP value is obtained through an estimation method of Van Krevelen and Hoftyzer. In the estimation method of Van Krevelen and Hoftyzer, it is thought that the cohesive energy density depends on the kind and the number of substituents, and the SP value of a polymer is calculated in units of segments on the basis of a cohesive energy value determined for each substituent. Many cohesive energy values calculated in the estimation method of Van Krevelen and Hoftyzer are in an experimental value range, and have a characteristic in that these have high practicability. Cohesive energy is divided by a molar volume of a substance, and a square root is employed as a SP value (reference literature: SP value Basics/Applications and Calculation Method, written by Hideki Yamamoto, Johokiko Co., Ltd., 2005). Conventionally, the SP value is obtained so that its unit is $cal^{1/2}/cm^{3/2}$, and is expressed in a dimensionless manner. In addition to this, in this specification, since a relative difference between SP values of two compounds have a meaning, a value obtained in accordance with the above-described practice is used and expressed in a dimensionless manner.

When the SP value is converted in SI ($J^{1/2}/m_{3/2}$) units, 2046 may be multiplied.

The release agent that is not eluted in the carrier liquid at a temperature lower than the glass transition temperature of the binder resin is a release agent having an elution ratio of less than 5% by weight with respect to the carrier liquid. The measurement of the elution ratio of the release agent is as follows.

First, 10 g of release agent particles having an average particle diameter of 3 mm are dipped in 90 g of a carrier liquid and allowed to stand still for 6 hours under an environment of a temperature that is lower than the glass transition temperature of the binder resin of the toner by 2° C. After the still standing, the liquid and the release agent particles (solid content) in the carrier liquid are separated using a sieve immediately after extraction of the carrier liquid from this environment. The mass of the separated release agent particles (solid content) is measured, and through the following expression, the elution ratio of the release agent in the carrier liquid is calculated.

elution ratio of release agent=(release agent particles separated from carrier liquid/mass of release agent particles before dipping in carrier liquid)×100 Expression:

The average particle diameter of the release agent particles is a value that is calculated from an average value of maximum diameters of 100 particles that are measured using an optical microscope (VHX-1000 manufactured by Keyence Corporation).

Liquid Developer

Next, a configuration of a liquid developer according to this exemplary embodiment will be described in detail.

Toner

The toner contains, for example, a binder resin and a release agent. If necessary, the toner may contain a colorant and other additive components.

Binder Resin

As the binder resin, a binder resin having a difference (ΔSP (tc)) in SP value from the carrier liquid of from 1.5 to 7.0 is used. Accordingly, a binder resin having ΔSP (tc) in the above range is selected and used in accordance with the SP value of the carrier liquid.

The binder resin is not particularly limited as long as it satisfies the above requirement of ΔSP (tc), but is preferably a material synthesized by a polyaddition reaction or a polycondensation reaction in view of low-temperature fixability and preservation stability. Specific examples thereof include a polyester resin, a polyurethane resin, an epoxy resin, and a polyol resin. Among these, a polyester resin is preferably used from the viewpoint of compatibility with a crystalline resin to be combined and used and encapsulation of the release agent.

As the binder resin, an amorphous resin and a crystalline resin are preferably used from the viewpoint of obtaining sharp melting characteristics upon fixing.

The "crystalline resin" means a crystalline resin that exhibits, not a stepwise change in the heat absorption amount, but a definite heat absorption peak in a differential scanning calorimetry (DSC), and has a weight average molecular weight greater than at least 5,000. In general, the crystalline resin has a weight average molecular weight of 10,000 or greater.

Crystalline Resin

The crystalline resin has a melting temperature, and thus shows a remarkable reduction in the viscosity at a specific temperature. Whereby, when the toner is heated upon fixing, a difference in temperature from when the thermal activity of crystalline resin molecules is started to when the crystalline resin molecules may be fixed may be reduced, and thus excellent low-temperature fixability may be applied. The content of the crystalline resin in the toner particles is preferably from 1% by weight to 10% by weight, and more preferably from 2% by weight to 8% by weight.

As the crystalline resin, a material having a melting point of from 45° C. to 110° C. is appropriately used in order to secure low-temperature fixability and toner preservation stability. The melting temperature is more preferably from 50° C. to 100° C., and even more preferably from 55° C. to 90° C. The melting temperature is obtained by the method according to ASTMD3418-8.

The number average molecular weight (Mn) of the crystalline resin is preferably 2,000 or greater, and more preferably 4,000 or greater.

As the crystalline resin, a resin having a weight average molecular weight greater than 5,000 and crystallinity is preferable, and specific examples thereof include crystalline polyester resins and crystalline vinyl resins. Among these, crystalline polyester resins are preferable. In addition, aliphatic crystalline polyester resins having an appropriate melting temperature are more preferable.

Examples of the crystalline vinyl resins include long-chain alkyls such as amyl(meth)acrylate, hexyl(meth)acrylate, heptyl(meth)acrylate, octyl(meth)acrylate, nonyl(meth)acrylate, decyl(meth)acrylate, undecyl(meth)acrylate, tridecyl(meth)acrylate, myristyl(meth)acrylate, cetyl(meth)acrylate, stearyl(meth)acrylate, oleyl(meth)acrylate, and behenyl(meth)acrylate, and vinyl resins using alkenyl(meth)acrylic ester. In this specification, the term "(meth)acryl" is intended to mean both "acryl" and "methacryl".

The crystalline polyester resin is synthesized from, for example, a carboxylic acid (dicarboxylic acid) component and an alcohol (dial) component. The carboxylic acid component and the alcohol component will be described in detail. In this exemplary embodiment, a copolymer in which 50% by weight or less of a component is copolymerized with a main chain of the crystalline polyester resin is also called a crystalline polyester resin.

The carboxylic acid component is preferably an aliphatic dicarboxylic acid, and particularly preferably a straight-chain carboxylic acid. Examples thereof include, but are not limited to, oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid, lower alkyl esters thereof, and acid anhydrides thereof.

As the carboxylic acid component, constituent components such as a dicarboxylic acid component having a double bond and a dicarboxylic acid component having a sulfonate group are preferably included, as well as the above-described aliphatic dicarboxylic acid component. As the dicarboxylic acid component having a double bond, constituent components derived from the dicarboxylic acid having a double bond and constituent components derived from lower alkyl ester or acid anhydride of the dicarboxylic acid having a double bond are also included. In addition, as the dicarboxylic acid component having a sulfonate group, constituent components derived from the dicarboxylic acid having a sulfonate group and constituent components derived from lower alkyl ester or acid anhydride of the dicarboxylic acid having a sulfonate group are also included.

The dicarboxylic acid having a double bond may crosslink the entire resin by using its double bond, and is preferably used. Examples of such dicarboxylic acid include, but are not limited to, fumaric acid, maleic acid, 3-hexene dioic acid, and 3-octene dioic acid. In addition, lower alkyl esters thereof and acid anhydrides thereof are also included. Among these, fumaric acid, maleic acid, and the like are preferable in view of cost.

The dicarboxylic acid having a sulfonate group is effectively used in view of good dispersion of a coloring material such as a pigment. In addition, when a sulfonate group is present when the entire resin is emulsified or suspended in water to prepare particles, emulsification or suspension may be performed without using a surfactant as will described later. Examples of such dicarboxylic acid having a sulfonate group include, but are not limited to, sodium 2-sulfoterephthalate, sodium 5-sulfoisophthalate, and sodium sulfosuccinate. In addition, lower alkyl esters thereof and acid anhydrides thereof are also included. Among these, sodium 5-sulfoisophthalate and the like are preferable in view of cost.

The content of these carboxylic acid components (dicarboxylic acid component having a double bond and dicarboxylic acid component having a sulfonate group) other than the aliphatic dicarboxylic acid component in the carboxylic acid components is preferably from 1 constituent mol % to 20 constituent mol %, and more preferably from 2 constituent mol % to 10 constituent mol %.

In this exemplary embodiment, "constituent mol %" is a percentage when each constituent component (carboxylic acid component and alcohol component) in the polyester resin is set as a unit (mol).

As the alcohol constituent component, an aliphatic diol is preferable, and examples thereof include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1-20-eicosanediol.

Regarding the alcohol component, the content of an aliphatic diol component is preferably 80 constituent mol % or greater, and other components may be included. The content of an aliphatic diol component as the alcohol component is more preferably 90 constituent mol % or greater.

Examples of other components include constituent components such as a diol component having a double bond and a dial component having a sulfonate group.

Examples of the dial having a double bond include 2-butene-1,4-diol, 3-butene-1,6-diol, and 4-butene-1,8-diol. Examples of the diol having a sulfonate group include sodium benzene 1,4-dihydroxy-2-sulfonate, sodium benzene 1,3-dihydroxymethyl-5-sulfonate, and 2-sulfo-1,4-butanediol sodium salt.

When these alcohol components (diol component having a double bond and a diol component having a sulfonate group) other than the straight-chain aliphatic dial component are added, the content thereof in the alcohol components is preferably from 1 constituent mol % to 20 constituent mol %, and more preferably from 2 constituent mol % to 10 constituent mol %.

The crystalline polyester resin manufacturing method is not particularly limited, and the crystalline polyester resin is manufactured with a general polyester polymerization method including reacting a carboxylic acid component with an alcohol component. Examples of the method include direct polycondensation and an ester exchange method, and different manufacturing methods are used for each monomer type. The molar ratio (acid component/alcohol component) in the reaction of an acid component with an alcohol component depends on the reaction conditions, and is generally 1/1 although may not be said unconditionally.

The crystalline polyester resin is manufactured at a polymerization temperature of from 180° C. to 230° C., and the reaction is caused while removing water or alcohol that is generated upon condensation. The pressure in the reaction system may be reduced. When the monomer is not dissolved or compatibilized under the reaction temperature, a solvent having a high boiling point may be added as a solubilization agent to dissolve the monomer. The polycondensation reaction is caused while distilling off the solubilization agent. In the copolymerization reaction, when a monomer inferior in compatibility is present, the monomer inferior in compatibility may be condensed in advance with the carboxylic acid component or alcohol component to be polycondensed with the monomer, and then polycondensed together with the main component.

As a catalyst that may be used in the manufacture of the crystalline polyester resin, alkali metal compounds such as sodium and lithium; alkaline earth metal compounds such as magnesium and calcium; metal compounds such as zinc, manganese, antimony, titanium, tin, zirconium, and germanium; phosphorous acid compounds, phosphoric acid compounds and amine compounds are exemplified. Specifically, the following compounds are exemplified.

Examples include compounds such as sodium acetate, sodium carbonate, lithium acetate, calcium acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl) phosphite, ethyltriphenylphosphonium bromide, triethylamine, and triphenylamine.

In order to adjust the melting temperature, the molecular weight, and the like of the crystalline resin, a compound having a shorter-chain alkyl group, an alkenyl group, an aromatic ring, or the like may be used, other than the polymerizable monomer.

Specific examples of the compound when the compound is a dicarboxylic acid include alkyl dicarboxylic acids such as succinic acid, malefic acid, and oxalic acid, aromatic dicarboxylic acids such as phthalic acid, isophthalic acid, terephthalic acid, homophthalic acid, 4,4'-bibenzoic acid, 2,6-naphthalene dicarboxylic acid, and 1,4-naphthalene dicarboxylic acid, and nitrogen-containing aromatic dicarboxylic acids such as dipicolinic acid, dinicotinic acid, quinolinic acid, and 2,3-pyrazine dicarboxylic acid. Specific examples of the compound when the compound is a diol include diols of short-chain alkyls such as succinic acid, malonic acid, acetone dicarboxylic acid, and diglycolic acid. Specific examples of the compound when the compound is a vinyl polymerizable monomer of a short-chain alkyl include (meth) acrylic esters of short-chain alkyl/alkenyls such as methyl (meth)acrylate, ethyl(meth)acrylate, propyl(meth)acrylate, and butyl(meth)acrylate, vinyl nitriles such as acrylonitrile and methacrylonitrile, vinyl ethers such as vinyl methyl ether and vinyl isobutyl ether, vinyl ketones such as vinyl methyl ketone, vinyl ethyl ketone, and vinyl isopropenyl ketone, and olefins such as ethylene, propylene, butadiene, and isoprene. These polymerizable monomers may be used alone or in combination of two or more types thereof.

Amorphous Resin

As the amorphous resin, a known amorphous resin for toner is used. For example, a styrene-acrylic resin and the like may be used, and an amorphous polyester resin is preferably used.

The glass transition temperature (Tg) of the amorphous polyester resin is preferably 50° C. to 80° C., and more preferably from 55° C. to 65° C. In addition, the weight average molecular weight is preferably from 8000 to 30000, and more preferably from 8000 to 16000. A third component may be copolymerized.

The amorphous polyester resin preferably has a common alcohol component or carboxylic acid component with the crystalline polyester compound to be used in combination with the amorphous polyester resin, to increase miscibility.

The amorphous polyester resin manufacturing method is not particularly limited, and the amorphous polyester resin may be manufactured with a general polyester polymerization method as described above.

As the carboxylic acid component that is used in the synthesis of the amorphous polyester resin, various dicarboxylic acids exemplified with respect to the crystalline polyester resin are used. As the alcohol component, various diols that are used in the synthesis of the amorphous polyester resin are used, and in addition to the aliphatic diols exemplified with respect to the crystalline polyester resin, bisphenol A, an ethylene oxide adduct of bisphenol A, a propylene oxide adduct of bisphenol A, hydrogenated bisphenol A, bisphenol S, an ethylene oxide adduct of bisphenol S, and a propylene oxide adduct of bisphenol S may be used.

From the viewpoint of toner productivity, heat resistance, and transparency, bisphenol S and bisphenol S derivatives such as an ethylene oxide adduct of bisphenol S and a propylene oxide adduct of bisphenol S are particularly preferably used. In addition, the carboxylic acid component and the alcohol component may contain plural components, and particularly, bisphenol S has an effect of improving heat resistance.

Next, a crosslinking treatment for the amorphous resin or the crystalline resin that is used as a binder resin, a copolymerization component usable in the synthesis of the binder resin, and the like will be described.

In the synthesis of the binder resin, other components may be copolymerized, or a compound having a hydrophilic polar group may be used.

Specific examples of other components when the binder resin is a polyester resin include dicarboxylic acid compounds having an aromatic ring substituted directly with a sulfonyl group, such as sodium sulfonyl-terephthalate and sodium 3-sulfonyl isophthalate. Specific examples of other components when the binder resin is a vinyl resin include unsaturated aliphatic carboxylic acids such as (meth)acrylic acid and itaconic acid, esters of (meth)acrylic acids and alcohols such as glycerin mono(meth)acrylate, fatty acid-modified glycidyl(meth)acrylate, zinc mono(meth)acrylate, zinc di(meth)acrylate, 2-hydroxyethyl(meth)acrylate, polyethylene glycol(meth)acrylate, and polypropylene glycol(meth) acrylate, styrene derivatives having a sulfonyl group in the ortho-, meta- or para-position, and sulfonyl group-substituted aromatic vinyls such as sulfonyl group-containing vinyl naphthalene.

A crosslinking agent may be added to the binder resin.

Specific examples of the crosslinking agent include aromatic polyvinyl compounds such as divinyl benzene and divinyl naphthalene, polyvinyl esters of aromatic polyvalent carboxylic acids such as divinyl phthalate, divinyl isophthalate, divinyl terephthalate, divinyl homophthalate, divinyl/trivinyl trimesate, divinyl naphthalenedicarboxylate, and divinyl biphenylcarboxylate, divinyl esters of nitrogen-containing aromatic compounds such as divinyl pyridinedicarboxylate, unsaturated heterocyclic compounds such as pyrrole and thiophene, vinyl esters of unsaturated heterocyclic compound carboxylic acids such as vinyl pyromucate, vinyl furancarboxylate, vinyl pyrrole-2-carboxylate, and vinyl thiophenecarboxylate, (meth)acrylic esters of straight-chain polyols such as butanediol methacrylate, hexanediol acrylate, octanediol methacrylate, decanediol acrylate, and dodecanediol methacrylate, (meth)acrylic esters of branched and substituted polyols such as neopentyl glycol dimethacrylate and 2-hydroxy-1,3-diacryloxypropane, polyethylene glycol di(meth)acrylates, polypropylene polyethylene glycol di(meth)acrylates, and polyvinyl esters of polyvalent carboxylic acids such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioic acid, and divinyl brassylate.

particularly, in the crystalline polyester resin, a method in which unsaturated polycarboxylic acids such as fumaric acid, maleic acid, itaconic acid, and trans-aconitic acid are copolymerized in a polyester, and then multiple bonds in the resin may be crosslinked or another vinyl compound is used to perform crosslinking may be used. In this exemplary embodiment, these crosslinking agents may be used alone or in combination of two or more types thereof.

A crosslinking method using the crosslinking agent may be a method of performing crosslinking by polymerizing a polymerizable monomer together with a crosslinking agent, or a method in which after a binder resin is polymerized while unsaturated parts are allowed to remain in the binder resin, or after a toner is prepared, the unsaturated parts are crosslinked by a crosslinking reaction.

When the binder resin is a polyester resin, the polymerizable monomer may be polymerized by condensation polymerization. A known catalyst is used as a catalyst for condensation polymerization, and specific examples thereof include titanium tetrabutoxide, dibutyltin oxide, germanium dioxide, antimony trioxide, tin acetate, zinc acetate, and tin disulfide. When the binder resin is a vinyl resin, the polymerizable monomer may be polymerized by radical polymerization.

A radical polymerization initiator is not particularly limited as long as it is emulsion-polymerizable. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, peroxy carbonate, diisopropyl tetralin hydroperoxide, 1-phenyl-2-methylpropyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, and tert-butyl perN-(3-toluoyl)carbamate, azo compounds such as 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenyl azodiphenyl methane, phenyl azotriphenyl methane, 4-nitrophenyl azotriphenyl methane, 1,1'-azobis-1,2-diphenyl ethane, poly(bisphenol A-4,4'-azobis-4-cyanopentanoate), and poly(tetraethyleneglycol-2,2'-azobisisobutyrate), 1,4-bis(pentaethylene)-2-tetrazene, and 1,4-dimethoxycarbonyl-1,4-diphenyl-2-tetrazene. These polymerization initiators may also be used as initiators for the crosslinking reaction.

The binder resin has been described by referring mainly to the crystalline polyester resin and the amorphous polyester resin. However, it is also possible to use styrenes such as styrene, parachlorostyrene, and α-methyl styrene; acrylic monomers such as methyl acrylate, ethyl acrylate, n-propyl acrylate, butyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylenically unsaturated acid monomers such as acrylic acid, methacrylic acid, and sodium styrenesulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; homopolymers of olefinic monomers such as ethylene, propylene, and butadiene, copolymers including a combination of two or more types of these monomers, or mixtures thereof, non-vinyl condensed resins such as an epoxy resin, a polyester resin, a polyurethane resin, a polyamide resin, a cellulose resin, and a polyether resin, or mixtures thereof with vinyl resins, and graft polymers obtained by polymerizing vinyl monomers with the coexistence of these resins.

When the toner is prepared by an emulsion polymerization and aggregation method as will be described later, the resin is prepared as a resin particle dispersion. The resin particle dispersion is easily obtained by an emulsion polymerization method or by a polymerization method in a heterogeneous dispersion system similar to the emulsion polymerization method. Alternatively, the resin particle dispersion may be obtained by a method such as a method including adding, together with a stabilizer, a polymer uniformly polymerized in advance by a solution polymerization method or a bulk polymerization method to a solvent in which the polymer is not dissolved, and mechanically mixing and dispersing it.

For example, when a vinyl monomer is used, a resin particle dispersion may be prepared by an emulsion polymerization method or a seed polymerization method using an ionic surfactant or the like, preferably an ionic surfactant and a nonionic surfactant in combination.

Examples of the surfactant that is used herein include, but are not limited to, anionic surfactants based on sulfates, sulfonates, phosphates, and soap; cationic surfactants based on amine salts and quaternary ammonium salts; nonionic surfactants based polyethylene glycol, alkyl phenol ethylene oxide adducts, alkyl alcohol ethylene oxide adducts, and polyols, as well as various graft polymers.

When the resin particle dispersion is prepared by emulsion polymerization, an unsaturated acid such as acrylic acid, methacrylic acid, maleic acid, or styrenesulfonic acid is particularly preferably used as a part of the monomer component so that a protective colloidal layer may be formed on the surfaces of particles to perform soap-free polymerization.

The volume average particle diameter of the resin particles is preferably 1 μm or less, and more preferably from 0.01 μm to 1 μm. The average particle diameter of the resin particles is measured by using a laser diffraction-type particle size distribution measuring device (manufactured by Shimadzu Corporation, SALD2000A).

Release Agent

As the release agent, a release agent that is not eluted in the carrier liquid at a temperature lower than the glass transition temperature of the binder resin is used. Accordingly, a release agent that is not eluted in the carrier liquid at a temperature lower than the glass transition temperature of the binder resin is selected and used in accordance with the carrier liquid.

The release agent is not particularly limited as long as it is not eluted in the carrier liquid at a temperature lower than the glass transition temperature of the binder resin, and examples thereof include low-molecular polyolefins such as polyethylene, polypropylene, and polybutene; silicones; fatty acid amides such as oleic acid amide, erucic acid amide, ricinoleic acid amide, and stearic acid amide; vegetable waxes such as carnauba wax, rice wax, candelila wax, Japan wax, and jojoba oil; animal waxes such as bees wax; mineral or petroleum waxes such as montan wax, ozokerite, ceresin, paraffin wax, microcrystalline wax, and Fischer Tropsch wax, and modified products thereof.

Here, a release agent having the above-described properties preferably has a molecular structure similar to that of the carrier liquid. Specifically, for example, when a paraffin-based carrier liquid is applied, paraffin-based wax is preferably applied as a release agent.

When the toner is prepared using an emulsion polymerization and aggregation method, these release agents may be dispersed in water together with an ionic surfactant, or a polymeric electrolyte such as a polymeric acid, polymeric base, heated to the melting temperature or higher, finely divided by using a homogenizer or a pressure discharge-type dispersing machine capable of giving a strong shearing force, and used as a release agent dispersion containing release agent particles having an average particle diameter of 1 μm or less.

In the preparation of the toner, these release agent particles may be added to a mixed solvent once or multiple times in divided portions, together with the other resin particle components.

The amount of the release agent to be added is preferably from 0.5% by weight to 50% by weight with respect to the entire toner particles. The amount of the release agent to be added is more preferably from 1% by weight to 30% by weight, and even more preferably from 5% by weight to 15% by weight.

In addition, the average dispersion diameter of the release agent that is dispersed and contained in the toner is preferably from 0.3 μm to 0.8 μm, and more preferably from 0.4 μm to 0.8 μm.

In addition, the standard deviation of the dispersion diameter of the release agent is preferably 0.05 or less, and more preferably 0.04 or less.

The average dispersion diameter of the release agent that is dispersed and contained in the toner is obtained by analyzing a TEM (transmission electron microscope) photograph with an image analyzer (manufactured by Nireko Corporation, Luzex image analyzer) and calculating a mean dispersion diameter (=(major axis+minor axis)/2) of the release agent in 100 toner particles, and on the basis of the individual dispersion diameters thus obtained, the standard derivation is obtained.

The exposure ratio of the release agent to a toner surface is preferably from 5 atom % to 12 atom %, and more preferably from 6 atom % to 11 atom %.

Here, the exposure ratio is obtained by X-ray photoelectron spectroscopy (XPS) measurement. As an XPS measuring device, JPS-9000MX manufactured by JEOL Ltd. is used, and the measurement is performed using MgKα ray as an X-ray source at an accelerating voltage set to 10 kV and an emission current set to 30 mA. Here, the amount of the release agent on a toner surface is quantified by a method of peak separation of C1S spectrum. In the peak separation method, the measured C1S spectrum is separated into components by curve fitting through a least square method. As component spectra as a base of the separation, C1S spectra obtained by individually measuring the release agent, the binder resin, and the crystalline resin used in preparing the toner are used.

Colorant

Examples of the colorant include various pigments such as carbon black, chrome yellow, hanza yellow, benzidine yellow, threne yellow, quinoline yellow, permanent orange GTR, pyrazolone orange, vulcan orange, Watchung red, permanent red, brilliant carmine 3B, brilliant carmine 6B, DuPont oil red, pyrazolone red, lithol red, rhodamine B lake, lake red C, rose Bengal, aniline blue, ultramarine blue, chalco oil blue, methylene blue chloride, phthalocyanine blue, phthalocyanine green, and malachite green oxalate, various dyes based on acridine, xanthene, azo, benzoquinone, azine, anthraquinone, thioindigo, dioxazine, thiazine, azomethine, indigo, phthalocyanine, aniline black, polymethine, triphenyl methane, diphenyl methane, and thiazole, and mixtures with one or two or more types thereof.

When the toner is prepared using an emulsion polymerization and aggregation method, these colorants are also dispersed in a solvent and used as a colorant dispersion. In this case, the volume average particle diameter of colorant particles is preferably 0.8 μm or less, and more preferably from 0.05 μm to 0.5

The presence ratio of coarse particles having a volume average particle diameter of 0.8 μm or greater in the colorant dispersion is preferably less than 10 number %, and more preferably O number %. The presence ratio of fine particles having an average particle diameter of 0.05 μm or less in the colorant dispersion is preferably 5 number % or less.

The volume average particle diameter of the colorant particles is also measured by using a laser diffraction-type particle size distribution measuring device (manufactured by Shimadzu Corporation, SALD2000A). The amount of the colorant to be added is preferably set to from 1% by weight to 20% by weight with respect to the entire toner particles.

As a method of dispersing the colorant in a solvent, a method using a rotation shearing-type homogenizer or a ball mill, sand mill or DYNO mill having media may be used, and the method is not particularly limited.

The colorant used may be surface-modified with rosin, polymer, or the like. The surface-modified colorant is preferable in that it is stabilized in the colorant dispersion, and when the colorant is dispersed to have a desired average particle diameter in the colorant dispersion and then mixed with the resin particle dispersion, the colorant particles are not aggregated even in an aggregation step and its good dispersion state may be maintained.

Examples of the polymer that is used in the surface treatment of the colorant include an acrylonitrile polymer and a methyl methacrylate polymer.

As conditions for the surface modification, a polymerization method of polymerizing a monomer in the presence of a colorant (pigment), a phase separation method including dispersing a colorant (pigment) in a polymer solution and lowering the solubility of the polymer to precipitate the polymer on the surface of the colorant (pigment), or the like is generally used.

Other Additive Components

Various known additive components are exemplified as other additive components.

Specifically, when the toner is used as a magnetic toner, a magnetic powder is contained therein. Examples of the magnetic powder include metals such as ferrite, magnetite, reduced iron, cobalt, nickel, and manganese, alloys thereof, and compounds containing the metals. Various charge-controlling agents such as quaternary ammonium salts, nigrosine compounds, and triphenyl methane pigments, that are generally used, may be added.

The toner may contain inorganic particles. Inorganic particles having a median particle diameter of from 5 nm to 30 nm and inorganic particles having a median particle diameter of from 30 nm to 100 nm are preferably contained in the range of from 0.5% by weight to 10% by weight with respect to the toner in view of durability.

Examples of the inorganic particles include silica, hydrophobized silica, titanium oxide, alumina, calcium carbonate, magnesium carbonate, tricalcium phosphate, colloidal silica, cation surface-treated colloidal silica, and anion surface-treated colloidal silica. These inorganic particles are previously subjected to a dispersion treatment in the presence of an ionic surfactant by using an ultrasonic dispersing machine or the like, and colloidal silica that does not require the dispersion treatment is more preferably used.

A known external additive may be externally added to the toner. That is, the toner may have toner particles containing the binder resin and the like, and an external additive. As the external additive, inorganic particles such as silica, alumina, titania, calcium carbonate, magnesium carbonate, and tricalcium phosphate are used. For example, inorganic particles such as silica, alumina, titania, and calcium carbonate, and resin particles such as vinyl resins, polyester, and silicone are used as a flowability auxiliary agent, a cleaning auxiliary agent, or the like. The method of adding the external additive is not particularly limited, and the external additive in a dried state may be added onto the surfaces of the toner particles by adding a shearing force.

Toner Manufacturing Method

Next, a toner manufacturing method will be described.

The toner may be prepared by any known toner manufacturing method, but is preferably manufactured by a so-called wet manufacturing method, that is, through a forming step of forming colored particles containing a binder resin and a colorant in water, an organic solvent, or a mixed solvent thereof, and a washing and drying step of washing and drying the colored particles, to control the above-described elemental composition of the toner particle surface.

Examples of such wet manufacturing method include, but are not limited to, a suspension and polymerization method that includes suspending a colorant, a release agent, and other components together with a polymerizable monomer that forms a binder resin such as an amorphous resin, to polymerize the polymerizable monomer, a dissolution and suspension method that includes dissolving toner constituent materials such as a compound having an ionic dissociating group, a binder resin, a colorant, and a release agent in an organic solvent, dispersing the mixture in a suspended state in an aqueous solvent, and then removing the organic solvent, and an emulsion polymerization and aggregation method that includes preparing a binder resin component such as an amorphous resin by emulsion polymerization, hetero-aggregating the binder resin component with a pigment dispersion, a release agent dispersion, and the like, and then coalescing them. Among these, an emulsion polymerization and aggregation method is most suitable due to excellent toner particle diameter controllability, narrow particle size distribution, shape controllability, narrow shape distribution, interior dispersion controllability, and the like.

When the emulsion polymerization and aggregation method is used, the toner may be manufactured at least through an aggregation step of forming aggregated particles in a raw material dispersion in which a resin particle dispersion containing a binder resin such as an amorphous resin and a crystalline resin dispersed therein, a colorant dispersion containing a colorant dispersed therein, and a release agent dispersion containing a release agent dispersed therein are mixed, and a coalescence step of coalescing the aggregated particles by heating the raw material dispersion containing the aggregated particles formed therein to a temperature not lower than the glass transition temperature of the binder resin (or melting temperature of the crystalline resin). Other dispersions such as an inorganic particle dispersion may be added to the raw material dispersion. Particularly, when a dispersion of surface-hydrophobized inorganic particles is added, dispersibility of the release agent and the crystalline resin in the toner may be controlled by a degree of hydrophobization.

Hereinafter, the emulsion polymerization and aggregation method will be described in detail as a specific example of the toner manufacturing method.

When the toner is prepared by the emulsion polymerization and aggregation method, the toner is prepared at least through the aggregation step and the coalescence step. However, an attachment step of forming aggregated particles having a core-shell structure in which resin particles are attached to surfaces of aggregated particles (core particles) formed through the aggregation step may be provided.

Aggregation Step

In the aggregation step, aggregated particles are formed in a raw material dispersion in which a resin particle dispersion (an amorphous resin dispersion, a crystalline resin dispersion and the like may be separately prepared) including a binder resin such as an amorphous resin and a crystalline resin dispersed therein, a colorant dispersion containing a colorant dispersed therein, and a release agent dispersion containing a release agent dispersed therein are mixed.

Specifically, a raw material dispersion obtained by mixing various dispersions is heated to aggregate particles in the raw material dispersion, thereby forming aggregated particles. The heating is performed at a temperature below the glass transition temperature of the amorphous resin. The temperature range is preferably from 5° C. to 25° C. lower than the glass transition temperature of the amorphous resin.

The formation of the aggregated particles is performed by adding an aggregating agent at room temperature (23° C.) under stirring in a rotation shearing-type homogenizer and by adjusting the pH of the raw material dispersion to an acidic value.

As the aggregating agent that is used in the aggregation step, a surfactant having an opposite polarity to a surfactant that is used as a dispersant to be added to the raw material dispersion, that is, a di- or higher valent metal complex may be preferably used in addition to an inorganic metal salt. Particularly, a metal complex is preferably used since the amount of the surfactant used is reduced and charging characteristics are improved.

Examples of the inorganic metal salt include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and polycalcium sulfide. Among these, aluminum salts and polymers thereof are particularly preferable. In order to obtain a sharper particle size distribution, the valence of the inorganic metal salt is more preferably divalent than monovalent, trivalent than divalent, or tetravalent than trivalent, and given the same valence, a polymerization-type inorganic metal salt polymer is more preferable.

Particularly, in order to control the presence ratios of the elements of Groups IIA, IIIB, and IVB (excluding carbon), it is preferable that an inorganic particle dispersion formed using an inorganic metal salt be added and aggregated particles be formed in the aggregation step. Accordingly, the elements effectively act on the terminals of the molecular chains of the binder resin, and contribute to the formation of a crosslinking structure.

The inorganic particle dispersion is prepared by the method that is also used for the colorant dispersion and the like, and the dispersion average particle diameter of the inorganic particles is preferably from 100 nm to 500 nm.

In the aggregation step, the inorganic particle dispersion may be added in stages or continuously. These methods are effective to achieve a uniform presence ratio from the toner surface to the inside of the toner. When the inorganic particle dispersion is added in stages, the dispersion is particularly preferably added in three or more stages, and when the inorganic particle dispersion is added continuously, the dispersion is particularly preferably added at a low rate of 0.1 g/m or less.

In addition, the amount of the inorganic particle dispersion to be added varies with the type of the metal to be required and the degree of the formation of the crosslinking structure, but is preferably from 0.5 part by weight to 10 parts by weight, and more preferably from 1 part by weight to 5 parts by weight with respect to 100 parts by weight of the binder resin component.

An attachment step may be performed after the aggregation step. In the attachment step, a coating layer is formed by attaching resin particles to the surfaces of the aggregated particles formed through the above-described aggregation step. Accordingly, a toner having a so-called core-shell structure constituted of a core layer and a cover layer (shell layer) covering the core layer is obtained.

In general, the coating layer is formed by additionally adding a dispersion containing amorphous resin particles to a dispersion containing the aggregated particles (core particles) formed in the aggregation step. The amorphous resin that is used in the attachment step may be the same as, or different from that used in the aggregation step.

Generally, the attachment step is used in the preparation of a toner having a core-shell structure in which together with a release agent, a crystalline resin as a binder resin is contained as a main component. A major object of this is to suppress exposure, to a toner surface, of the release agent and the crystalline resin contained in the core layer, and to compensate for the strength of toner particles.

Coalescence Step

In the coalescence step that is performed after the aggregation step, or after the aggregation step and the attachment step, the pH of the suspension containing the aggregated particles formed through these steps is adjusted in a required range to terminate the progress of the aggregation, and then heating is performed to coalesce the aggregated particles.

Particularly, by a target pH value at this time, the presence ratio of the elements of Group IA (excluding hydrogen) is controlled in a preferable range.

The pH adjustment is performed by adding an acid or an alkali. The acid is not particularly limited, and an aqueous solution of from 0.1% to 50% of an inorganic acid such as a hydrochloric acid, a nitric acid, and a sulfuric acid is preferable. The alkali is not particularly limited, and an aqueous solution of from 0.1% to 50% of a hydroxide of an alkali metal such as sodium hydroxide and potassium hydroxide is preferable. In the pH adjustment, when the pH is locally changed, the aggregated particles are locally broken and excessive aggregation locally occurs. In addition, the shape distribution also deteriorates. Particularly, the greater the scale, the greater the amount of the acid or alkali. In general, the acid and the alkali are added at one place. Accordingly, when the treatment is performed for the same period of time, the greater the scale, the higher the concentrations of the acid and the alkali at the addition position.

In order to adjust the presence ratio of the elements of Group IA (excluding hydrogen) in the range of this exemplary embodiment, the pH is preferably from 6.0 to 8.0, and more preferably from 6.5 to 7.5.

After the control of the composition, the aggregated particles are heated and coalesced. In the heating, the elements and the terminals of the molecular chains of the resin react with each other and a crosslinking structure is thus formed.

The aggregated particles are coalesced by performing the heating at a temperature not lower than the glass transition temperature of the amorphous resin (or melting temperature of the crystalline resin).

In the heating during the coalescing, or after the coalescing, a crosslinking reaction may be caused with other components. The crosslinking reaction may be caused together with the coalescing. When the crosslinking reaction is caused, the above-described crosslinking agent or polymerization initiator is used in the preparation of the toner.

The polymerization initiator may be previously mixed with the dispersion in the step of preparing the raw material dispersion, or may be incorporated in the aggregated particles in the aggregation step. The polymerization initiator may also be added in or after the coalescence step. When the polymerization initiator is added in the aggregation step, the attachment step, or the coalescence step, or after the coalescence step, a liquid in which the polymerization initiator is dissolved or emulsified is added to the dispersion. To these polymerization initiators, a crosslinking agent, a chain transfer agent, a polymerization inhibitor, and the like, that are known, may be added to control the polymerization degree.

Washing Step, Drying Step, Etc.

After the step of coalescing the aggregated particles, a washing step, a solid-liquid separation step, a drying step, and the like may be performed, and a desired toner (toner particles) is obtained through these steps. The washing step preferably includes displacement washing with ion exchange water in consideration of a charging property. In addition, the solid-liquid separation step is not particularly limited, but from the viewpoint of productivity, suction filtration, pressure filtration, and the like are preferable. Furthermore, the drying step is also not particularly limited, but from the viewpoint of productivity, freeze drying, flash jet drying, fluidized drying, vibration-type fluidized drying, and the like are preferably used. In addition, various external additives may be added to the toner (toner particles) after drying.

Physical Properties of Toner

Next, physical properties of the toner will be described.

The volume average particle diameter D50v of the toner is preferably from 0.1 μm to 10 μm, and more preferably from 1.0 μm to 4 μm.

The volume particle size distribution index GSDv of the toner is preferably 1.28 or less. The number particle size distribution index GSDp is preferably 1.30 or less. The volume particle size distribution index GSDv is more preferably 1.25 or less, and the number particle size distribution index GSDp is more preferably 1.25 or less.

Here, the volume average particle diameter D50v and various particle size distribution indice of the toner are measured by using, for example, Multisizer II (manufactured by Beckman Coulter, Inc.) with ISOTON-II (manufactured by Beckman Coulter, Inc.) as an electrolyte. In the measurement, from 0.5 mg to 50 mg of a measurement sample is added to 2 ml of a surfactant as a dispersant, preferably a 5% aqueous solution of sodium alkylbenzene sulfonate. The obtained material is added to from 100 ml to 150 ml of an electrolyte.

The electrolyte in which the sample is suspended is subjected to a dispersion treatment for 1 minute with an ultrasonic dispersing machine, and the particle size distribution of particles having a particle diameter of from 2.0 μm to 60 μm is measured by Multisizer II using an aperture having an aperture diameter of 100 μm. 50000 particles are sampled.

A cumulative distribution is drawn for volume and number from the smallest diameter side with respect to particle size ranges (channels) divided on the basis of the particle size distribution thus measured. The particle diameter when the cumulative percentage becomes 16% is defined as that corresponding to a cumulative volume particle diameter D16v and a cumulative number particle diameter D16p, while the particle diameter when the cumulative percentage becomes 50% is defined as that corresponding to a cumulative volume average particle diameter D50v and a cumulative number average particle diameter D50p. Furthermore, the particle diameter when the cumulative percentage becomes 84% is defined as that corresponding to a cumulative volume particle diameter D84v and a cumulative number particle diameter D84p. Using these, the volume particle size distribution index (GSDv) is calculated through the expression $(D84v/D16v)^{1/2}$, while the number particle size distribution index (GSDp) is calculated through the expression $(D84p/D16p)^{1/2}$.

The average circularity of the toner is preferably from 0.940 to 0.980, and more preferably from 0.950 to 0.970.

The average circularity of the toner is measured by a flow-type particle image analyzer FPIA-2000 (manufactured by Toa Medical Electronics Co., Ltd.). In a specific measurement method, from 0.1 ml to 0.5 ml of a surfactant as a dispersant, preferably alkylbenzene sulfonate, is added to from 100 ml to 150 ml of water from which solid impurities are previously removed, and from 0.1 g to 0.5 g of a measurement sample is added thereto. The suspension in which the measurement sample is dispersed is subjected to a dispersion treatment for from 1 minute to 3 minutes with an ultrasonic dispersing machine, and the average circularity of the toner is measured at a dispersion density of from 3000 particles/ill to 10,000 particles/μl by the above analyzer.

The glass transition temperature of the toner is not particularly limited, and is appropriately selected in the range of from 40° C. to 70° C.

The glass transition temperature of the toner is a value that is measured by a measurement method that is the same as the measurement method of the glass transition temperature of the binder resin.

Carrier Liquid

As the carrier liquid, a carrier liquid having a difference (ΔSP (tc)) in SP value from the binder resin of the toner of from 1.5 to 7.0 is used. Accordingly, a carrier liquid having ΔSP (tc) in the above range is selected and used in accordance with the SP value of the toner to be used.

The type of the carrier liquid is not particularly limited as long as it satisfies the above requirement of ΔSP (tc), and examples thereof include silicone oil and polyol.

Examples of the silicone oil include dimethyl silicone oil (commercialized products KF-96, KF-965, KF-968 and the like, manufactured by Shin-Etsu Chemical Co., Ltd.), methyl hydrogen silicone oil (KF-99 and the like, manufactured by Shin-Etsu Chemical Co., Ltd.), and methyl phenyl silicone oil (KE-50, KF-54, and the like, manufactured by Shin-Etsu Chemical Co., Ltd.).

Examples of the polyol include ethylene glycol (commercialized products manufactured by Wako Pure Chemical Industries, Ltd.), diethylene glycol (manufactured by Wako Pure Chemical Industries, Ltd.), and propylene glycol (manufactured by Wako Pure Chemical Industries, Ltd.).

In addition, other than the above-described materials, aliphatic hydrocarbon solvents such as paraffin oil (commercialized products Moresco White MT-30P, Moresco White P40, and Moresco White P70 all manufactured by Matsumura Oil Co., Ltd., and Isopar L and Isopar M all manufactured by Exxon Chemical Co., Ltd.), hydrocarbon solvents such as naphthenic oil (commercialized products Exxsol D80, Exxsol D110, and Exxsol D130 all manufactured by Exxon Chemical Co., Ltd., and Naphtesol L, Naphtesol M, Naphtesol H, New Naphtesol 160, New Naphtesol 200, New Naphtesol 220, and New Naphtesol MS-20P all manufactured by Nippon Petrochemicals Co. Ltd.), aromatic compounds such as toluene, cyclohexane, tetrahydrofuran, acetone, 2-butanol, and the like may also be used.

When, for example, a toner containing a crystalline polyester is used, it is particularly effective to combine silicone oil as a carrier liquid from the viewpoint of controlling ΔSP (tc) in the above range.

In an image forming apparatus and an image forming method to be described later, a difference (ΔSP (pt)) between SP values of a recording medium and the binder resin of the toner is preferably smaller than a difference (ΔSP (pc)) between SP values of a recording medium and the carrier liquid.

From the viewpoint of controlling the ΔSP (pt) and ΔSP (pc) in the above ranges, respectively, it is particularly effective to combine a toner containing a crystalline polyester, silicone oil as a carrier liquid, and paper including cellulose fiber as a recording medium.

The flash point of the carrier liquid is preferably 150° C. or higher, and more preferably 200° C. or higher.

The flash point is measured in accordance with JIS K2265-4 (2007).

The carrier liquid may contain various secondary materials such as a dispersant, an emulsifier, a surfactant, a stabilizer, a wetting agent, a thickener, a frothing agent, an antifoamer, a coagulant, a gelling agent, an antisetting agent, a charge-controlling agent, a charge prevention agent, an antioxidant, a softener, a plasticizer, a filler, a reodorant, an antitack agent, and a release agent.

Image Forming Apparatus and Image Forming Method

An image forming apparatus according to this exemplary embodiment is not particularly limited as long as it uses at least the above-described liquid developer according to this exemplary embodiment, and examples thereof include an image forming apparatus having: an electrostatic latent image holding member; a charging device that charges a surface of the electrostatic latent image holding member; a latent image forming device that forms an electrostatic latent image on the surface of the electrostatic latent image holding member; a developing device that contains the liquid developer according to this exemplary embodiment and develops the electrostatic latent image formed on the surface of the electrostatic latent image holding member with the liquid developer to form a toner image; a transfer device that transfers the toner image onto a recording medium; and a fixing device that fixes the toner image to the recording medium by heating and pressurizing the toner image on the recording medium.

In addition, an image forming method according to this exemplary embodiment is not particularly limited as long as it uses at least the above-described liquid developer according to this exemplary embodiment, and examples thereof include an image forming method including: a charging step of charging a surface of an electrostatic latent image holding member;

a latent image forming step of forming an electrostatic latent image on the surface of the electrostatic latent image holding member; a developing step of developing the electrostatic latent image formed on the surface of the electrostatic latent image holding member with the liquid developer according to this exemplary embodiment to form a toner image; a transfer step of transferring the toner image onto a recording medium; and a fixing step of fixing the toner image to the recording medium by heating and pressurizing the toner image on the recording medium.

In the image forming apparatus (image forming method), the fixing device (fixing step) preferably performs fixing in two stages. Specifically, the fixing device (fixing step) preferably includes a first heating device (first heating step) that performs heating a toner image to a temperature not lower than a temperature (A) at which the storage elastic modulus of the toner in the toner image is $1\times10^5$ Pa in a non-contact manner, and a second heating/pressurization device (second heating/pressurization step) that performs heating and pressurization at a temperature not lower than the temperature (A) after the heating in the first heating device (after first heating step).

In the first heating device (first heating step), the heating is performed in a non-contact manner from the viewpoint of securing toner fluidity. That is, the heating device that performs heating with no contact preferably performs heating from the side on which the toner image on the recording medium is formed, from the back side of the recording medium (the toner image is not formed), or from both of the sides.

In addition, in the image forming apparatus and the image forming method according to this exemplary embodiment, a difference (ΔSP (pt)) between SP values of a recording medium and the binder resin of the toner is preferably smaller than a difference (ΔSP (pc)) between SP values of a recording medium and the carrier liquid.

The recording medium is not particularly limited, and a known recording medium is applied. Examples thereof include paper including cellulose fiber, paper (coated paper) in which various coating layers are formed on cellulose fiber, labels, and films (such as polyethylene, polyester, polycarbonate, polypropylene, polystyrene, and polyvinyl alcohol).

From the viewpoint of controlling ΔSP (pt) and ΔSP (pc) in the above ranges, respectively, it is particularly effective to combine a toner containing a crystalline polyester, silicone oil as a carrier liquid, and paper including cellulose fiber as a recording medium.

Hereinafter, the image forming method and a configuration of the image forming apparatus according to this exemplary embodiment will be described in detail using the drawings.

FIG. 1 is a schematic diagram showing a configuration of an example of the image forming apparatus according to this exemplary embodiment.

An image forming apparatus 100 includes a photoreceptor (electrostatic latent image holding member) 10, a charging device 20, an exposure device (latent image forming device) 12, a developing device 14, an intermediate transfer member 16, a cleaner 18, a transfer roller (transfer device) 28, a non-contact heating device (first heating device) 32, and heating/pressurization rolls (second heating/pressurization device) 34A and 34B.

The photoreceptor 10 has a circular cylindrical shape, and around the photoreceptor 10, the charging device 20, the exposure device 12, the developing device 14, the intermediate transfer member 16, and the cleaner 18 are provided in order. The transfer roller 28 is provided at a position in which a toner image 26 transferred onto the intermediate transfer member 16 is transferred onto paper (recording medium) 30, the non-contact heating device (first heating device) 32 is provided on the downstream side of the transfer roller 28 in the traveling direction of the paper 30, and a pair of the heating/pressurization rolls (second heating/pressurization device) 34A and 348 are provided on the downstream side of the non-contact heating device 32 in the traveling direction of the paper 30. In this exemplary embodiment, the non-contact heating device (first heating device) 32 and the heating/pressurization rolls (second heating/pressurization device) 34A and 34B constitute the fixing device.

Hereinafter, operations of the image forming apparatus 100 will be briefly described.

The charging device 20 charges a surface of the photoreceptor 10 to a preset potential, and the exposure device 12 exposes the charged surface with, for example, laser beams on the basis of an image signal, thereby forming an electrostatic latent image.

The developing device 14 includes a developing roller 14*a* and a developer storage container 14*b*. The developing roller 14*a* is provided so as to be partially dipped in a liquid developer 24 accommodated in the developer storage container 14*b*. Toner particles are dispersed in the liquid developer 24, and further, for example, the liquid developer 24 may be stirred by a stirring member provided in the developer storage container 14*b*.

The liquid developer 24 supplied to the developing roller 14*a* is transported to the photoreceptor 10 in a state in which the supply amount is limited to a set amount by a regulating member, and is supplied to the electrostatic latent image at a position in which the developing roller 14*a* and the photoreceptor 10 face (or are brought into contact with) each other. Thereby, the electrostatic latent image is developed to form a toner image 26.

The developed toner image 26 is transported to the photoreceptor 10 that rotates in a direction of the arrow in the drawing, and is transferred onto paper (recording medium) 30. However, in this exemplary embodiment, before being transferred onto the paper 30, the toner image is first transferred onto the intermediate transfer member 16. At this time, a peripheral speed difference between the photoreceptor 10 and the intermediate transfer member 16 may be provided.

Next, the toner image transported in a direction of the arrow C by the intermediate transfer member 16 is transferred to the paper 30 at a position in contact with the transfer roller 28.

The non-contact heating device (first heating device) 32 is provided downstream of the transfer roller 28 in the traveling direction of the paper 30. The non-contact heating device 32 is a plate-like heating device, and a heater is provided inside the plate-like member having a metal surface. The toner image is heated to a temperature not lower than the temperature (A) at which the storage elastic modulus of the toner is $1\times10^5$ Pa at the position of the non-contact heating device 32.

For example, when the toner image is heated in a non-contact manner from the toner image side that is a heating target, examples of the heater that is used in the heating device 32 include a halogen heater and a hot-air dryer. When the toner image is heated from the back side of the toner image that is a heating target, examples of the heater include a heating plate and a heating roll that are brought into contact with the back side.

The temperature of the heating in the non-contact heating device 32 is preferably 90° C. or higher, and more preferably from 100° C. to 125° C. In addition, the heating time is determined by the length of the non-contact heating device 32 in the traveling direction of the paper 30 and the processing speed.

The heating/pressurization rolls (second heating/pressurization device) 34A and 34B are provided downstream of the non-contact heating device (first heating device) 32 in the traveling direction of the paper 30. The toner image heated by the non-contact heating device 32 is further heated and pressurized at a temperature not lower than the temperature (A) by the heating/pressurization rolls 34A and 34B, and is thus fixed to the paper 30.

The heating/pressurization rolls 34A and 34B are opposed to each other so as to form a nip with paper 30 interposed therebetween. In the heating/pressurization rolls 34A and 34B, an elastic rubber layer and a release layer for toner release are formed on a metal roll, and paper 30 is nipped by a pressurization mechanism (not shown) so as to obtain a set pressure and a set nip width. In addition, at least one of the heating/pressurization rolls 34A and 34B is provided with a heater, but the heater may be provided in both of the heating/pressurization rolls 34A and 34B.

The temperature of the heating in the heating/pressurization rolls (second heating/pressurization device) 34A and 34B is preferably from 120° C. to 150° C., and more preferably from 130° C. to 140° C. In addition, the pressure to be applied is preferably from 1.5 $Kg/cm^2$ to 5 $Kg/cm^2$, and more preferably from 2 $Kg/cm^2$ to 3.5 $Kg/cm^2$.

A fixed image 29 is formed by fixing the toner image to the paper 30 at the position of the heating/pressurization rolls 34A and 34B, and then the paper 30 is transported up to a discharge part (not shown).

The photoreceptor 10 from which the toner image 26 is transferred onto the intermediate transfer member 16 is moved up to a position in contact with the cleaner 18, and the toner particles remaining after transferring are collected by the cleaner 18. When the transfer efficiency is close to 100% and the amount of the remaining toner is reduced, the cleaner 18 may not be provided.

The image forming apparatus 100 may be further provided with an erasing device (not shown) that erases the charge on the surface of the photoreceptor 10 after transferring until next charging.

All of the charging device 20, the exposure device 12, the developing device 14, the intermediate transfer member 16, the transfer roller 28, the cleaner 18, the non-contact heating device (first heating device) 32, and the heating/pressurization rolls (second heating/pressurization device) 34A and 34B, that are provided in the image forming apparatus 100, are operated in synchronization with the rotation speed of the photoreceptor 10.

Next, an image forming apparatus having another aspect according to this exemplary embodiment will be described in detail using the drawing.

Figure 2:
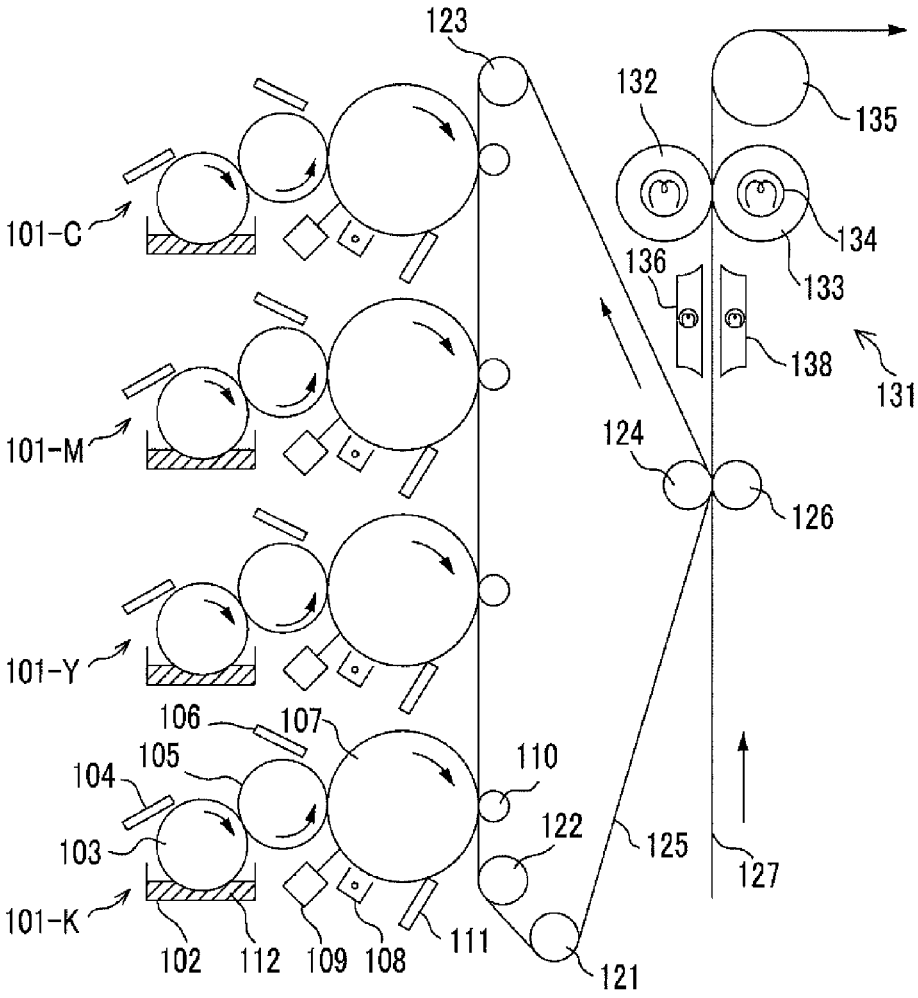
FIG. 2 is a schematic diagram showing a configuration of another example of the image forming apparatus of the exemplary embodiment.

FIG. 2 is a schematic diagram showing a configuration of an example of the image forming apparatus having another aspect according to this exemplary embodiment. The image forming apparatus is a tandem-type image forming apparatus.

The image forming apparatus shown in FIG. 2 has a cyan developing unit 101-C, a magenta developing unit 101-M, a yellow developing unit 101-Y, and a black developing unit 101-K. Each developing unit has a developer tank 102, a developer supply roll 103, a supply amount regulator 104, a developing roll (developing device) 105, a developing roll cleaner 106, a photoreceptor (electrostatic latent image holding member) 107, a charging device 108, an exposure device (latent image forming device) 109, a primary transfer device 110, and a photoreceptor cleaner 111. In addition, an intermediate transfer member 125 is provided so as to be brought into contact with the photoreceptors 107 of the four developing units, and secondary transfer devices 124 and 126 are provided to transfer a toner image transferred onto the intermediate transfer member 125 onto paper (recording medium) 127. A fixing unit (fixing device) 131 is provided on the downstream side of the secondary transfer devices 124 and 126 in the traveling direction of the paper 127, and a discharge roll 135 is provided on the downstream side of the fixing unit 131.

The fixing unit 131 is provided with non-contact heating devices (first heating device) 136 and 138, and a heating roll 132 and a pressure roll 133 (second heating/pressurization device) in order from the upstream side in the traveling direction of the paper 127.

A liquid developer 112 is maintained in a set amount in the developer tank 102 by a developer circulator (not shown), and is transported from the developer tank 102 to the developing roll 105 by the developer supply roll 103. The developer supply roll 103 has a system in which a surface is charged to attach a developer with an electrostatic force, a system in which a liquid is drawn and transported with grooves or depressions provided in the roll, or the like, and the supply amount regulator 104 regulates the transport amount to a set value. The photoreceptor 107 is charged by the charging device 108 so that its surface has a set charge bias amount, and an electrostatic latent image is formed on the surface by light beams from the exposure device 109 in accordance with an image signal sent from a host computer (not shown). The liquid developer on the developing roll 105 is transferred to the photoreceptor 107 in accordance with the electrostatic latent image to form a toner image, and the unnecessary developer is returned to the developer tank 102 by the developing roll cleaner 106 and the developer circulator (not shown).

The toner image formed on the photoreceptor 107 is transferred to the intermediate transfer member 125 by the primary transfer device 110. The intermediate transfer member 125 is supported by a driving roll 121, support rolls 122 and 123, and the secondary transfer device 124, and the driving roll 121 drives the intermediate transfer member 125 in the direction of the arrow by a driving motor and a power transmission mechanism (not shown), and gives a set tension to the intermediate transfer member 125 by a spring mechanism (not shown). The primary transfer devices 110 transfer a cyan toner image, a magenta toner image, a yellow toner image, and a black toner image onto the intermediate transfer member 125 in order with an electrostatic force and a pressure. There may be a difference in set potential between the primary transfer devices 110 corresponding to the respective colors. The liquid developer remaining on the photoreceptor 107 is removed by the photoreceptor cleaner 111.

The toner image transferred onto the intermediate transfer member 125 is transferred onto paper (recording medium) 127 by the secondary transfer devices 124 and 126, and is fixed by the fixing unit 131.

The fixing unit 131 has the first heating device and the second heating/pressurization device in order from the upstream side in the traveling direction of the paper 127, and has the non-contact heating devices 136 and 138 as the first heating device. The non-contact heating devices 136 and 138 are plate-like heating devices, and a heater is provided inside the plate-like member having a metal surface. The toner image is heated to a temperature not lower than the temperature (A) at which the storage elastic modulus of the toner is $1\times10^5$ Pa at the position of the non-contact heating devices 136 and 138.

The temperature of the heating in the non-contact heating devices 136 and 138 is preferably 90° C. or higher, and more preferably from 100° C. to 125° C. In addition, the heating time is determined by the lengths of the non-contact heating devices 136 and 138 in the traveling direction of the paper 127 and the processing speed.

In addition, the fixing unit 131 is provided with, as the second heating/pressurization device, a pair of the heating roll 132 and the pressure roll 133 and the heaters 134 provided inside the respective rolls. The toner image heated by the non-contact heating devices 136 and 138 is further heated and pressurized at a temperature not lower than the temperature (A) by the pair of the heating roil 132 and the pressure roll 133, and is thus fixed to the paper 127.

The heating roll 132 and the pressure roll 133 are opposed to each other so as to form a nip with paper 127 interposed therebetween. In each of the heating roll 132 and the pressure roll 133, an elastic rubber layer and a release layer for toner release are formed on a metal roll, and paper 127 is nipped by a pressurization mechanism (not shown) so as to obtain a set pressure and a set nip width. In addition, both of the heating roll 132 and the pressure roll 133 are provided with a heater, but the heater may be provided in only one of the heating roil 132 and the pressure roll 133.

The temperature of the heating in the heating roll 132 and the pressure roll 133 is preferably from 120° C. to 150° C., and more preferably from 130° C. to 140° C. In addition, the pressure to be applied is preferably from 1.5 $Kg/cm^2$ to 5 $Kg/cm^2$, and more preferably from 2 $Kg/cm^2$ to 3.5 $Kg/cm^2$.

The discharge roll 135 is provided on the downstream side of the fixing unit 131, and the paper 127 to which the toner image is fixed is transported to a discharge part (not shown) by the discharge roll 135.

As the first heating device, a plate-like heating device that performs heating from the back side (opposite side of the toner image) of a recording medium and is provided with a heater therein is shown in FIG. 1, and a system in which a plate-like heating device provided with a heater therein performs heating in a non-contact manner from both of the front and back sides of a recording medium is described in FIG. 2. However, the system of the first heating device is not limited thereto, and it is only necessary that heating be performed on the front side (toner image side) of a recording medium in a non-contact manner. For example, a plate-like heating device provided with a heater therein may perform heating only from the front side (toner image side) of a recording medium. In addition, a blower that blows hot wind or an irradiation device that applies infrared light may be applied.

In addition, as the second heating/pressurization device, a pair of the heating/pressurization rolls 34A and 34B is shown in FIG. 1, and a pair of the heating roll 132 and the pressure roll 133 is shown in FIG. 2. However, the second heating/pressurization device is not limited thereto, and for example, may be a device having a combination of a heating/pressurization roll and a pressurization belt or a device having a combination of a pressurization roll and a heating/pressurization belt.

In addition, the image forming apparatuses shown in FIGS. 1 and 2 may have a system in which a liquid developer is supplied to the developer storage container 14*b* or the developer tank 102 from a liquid developer cartridge (not shown) that is detachable from the image forming apparatus.

The developing device 14 in FIG. 1 may have a process cartridge system that is detachable from the image forming apparatus 100, or a process cartridge system in which the developer tank 102, the developer supply roll 103, the supply amount regulator 104, the developing roll 105, and the developing roll cleaner 106 in FIG. 2 are formed integrally with each other and detachable from the image forming apparatus may be provided.

EXAMPLES

Hereinafter, the invention will be described in more detail with examples, but is not limited to the following examples. In the following description, "parts" and "%" are based on the weight unless otherwise noted.

Method of Measuring Various Characteristics

First, a method of measuring physical properties of a toner and the like used in examples and comparative examples will be described.

Molecular Weight of Resin

A molecular weight of a resin is measured under the following conditions. "HLC-8120GPC, SC-8020 (manufactured by Tosoh Corporation) is used for GPC, two columns, "TSKgel and Super HM-H (manufactured by Tosoh Corporation, 6.0=ID×15 cm)" are used, and tetrahydrofuran (THF) is used as an eluent. As for the measurement conditions, the sample concentration is 0.5%, the flow rate is 0.6 ml/min, the sample injection amount is 10 the measurement temperature is 40° C., and a refractive index (RI) detector is used for a test. In addition, a calibration curve is prepared from 10 "polystyrene standard samples TSK Standards", manufactured by Tosoh Corporation: "A-500", "F-1", "F-10", "F-80", "F-380", "A-2500", "F-4", "F-40", "F-128", and "F-700".

Volume Average Particle Diameters of Toner, Resin Particles, Colorant Particles, Etc.

The volume average particle diameters of a toner, resin particles, colorant particles, and the like are measured by the following method.

When particles to be measured have a diameter of 2 μm or greater, Coulter Multisizer II (manufactured by Beckman Coulter, Inc.) is used as a measuring device, and ISOTON-II (manufactured by Beckman Coulter, Inc.) is used as an electrolyte to measure a particle diameter.

As for the measurement method, from 0.5 mg to 50 mg of a measurement sample is added to 2 ml of a surfactant as a dispersant, preferably a 5% aqueous solution of sodium alkylbenzene sulfonate. The obtained material is added to from 100 ml to 150 ml of an electrolyte. The electrolyte in which the measurement sample is suspended is subjected to a dispersion treatment for 1 minute with an ultrasonic dispersing machine, and the particle size distribution of particles having a particle diameter of from 2.0 μm to 60 μm is measured by Multisizer II using an aperture having an aperture diameter of 100 μm. 50,000 particles are measured.

A cumulative distribution is drawn for volume and number from the smallest diameter side with respect to particle size ranges (channels) divided on the basis of the particle size distribution thus measured. The particle diameter when the cumulative percentage becomes 16% in terms of volume is defined as a cumulative volume particle diameter D16v, and the particle diameter when the cumulative percentage becomes 16% in terms of number is defined as a cumulative number particle diameter D16p. In addition, the particle diameter when the cumulative percentage becomes 50% in terms of volume is defined as a cumulative volume particle diameter D50v, the particle diameter when the cumulative percentage becomes 50% in terms of number is defined as a cumulative number particle diameter D50p, the particle diameter when the cumulative percentage becomes 84% in terms of volume is defined as a cumulative volume particle diameter D84v, and the particle diameter when the cumulative percentage becomes 84% in terms of number is defined as a cumulative number particle diameter D84p. The volume average particle diameter is the above-described D50v.

Using these, the volume particle size distribution index (GSDv) is calculated through $(D84v/D16v)^{1/2}$, while the number particle size distribution index (GSDp) is calculated through $(D84p/D16p)^{1/2}$. The number particle size distribution on the small diameter side (lower GSDp) is calculated through {(D50p)/(D16p)}.

On the other hand, when particles to be measured have a diameter of less than 2 μm, a laser diffraction-type particle size distribution measuring device (LA-700: manufactured by Horiba, Ltd.) is used to perform the measurement. As for the measurement method, a sample in a state of a dispersion is adjusted so that the solid content is 2 g, and ion exchange water is added thereto to adjust a total volume of 40 ml. The sample is put into a cell so that an appropriate concentration is obtained, and is left for two minutes. The measurement is performed after the concentration in the cell is stabilized. The volume average particle diameter obtained for each channel is cumulated from the smallest volume average particle diameter side, and the diameter when the cumulative percentage becomes 50% is defined as the volume average particle diameter.

Glass Transition Temperature and Melting Temperature of Resin

The glass transition temperature (Tg) and the melting temperature (Tm) are obtained from maximum peaks measured according to ASTMD3418-8. The glass transition temperature is a temperature of the intersection between extensions of a base line and a rising line in a heat absorption part, and the melting temperature is a temperature of the apex of a heat absorption peak. A differential scanning calorimeter (DSC-7, manufactured by PerkinElmer Co., Ltd.) is used in the measurement.

Manufacturing of Toner

Manufacturing of Toner (1)

Preparation of Amorphous Polyester Resin (1) and Amorphous Resin Particle Dispersion (1a)

| | |
|---|---|
| polyoxyethylene (2,0)-2,2-bis(4-hydroxyphenyl)propane | 35 molar parts |
| polyoxypropylene (2,2)-2,2-bis(4-hydroxyphenyl)propane | 65 molar parts |
| terephthalic acid | 80 molar parts |
| n-dodecenyl succinic acid | 15 molar parts |
| trimellitic acid | 10 molar parts |

The above components and 0.05 molar parts of dibutyltin oxide with respect to these acid components (total number of moles of terephthalic acid, n-dodecenyl succinic acid, and trimellitic acid) are put into a heat-dried two-necked flask, nitrogen gas is supplied to the container to maintain an inert atmosphere, and the temperature is increased. Thereafter, a co-condensation polymerization reaction is caused for 12 hours at from 150° C. to 230° C., and then the pressure is gradually reduced at from 210° C. to 250° C. to synthesize an amorphous polyester resin (1).

The weight average molecular weight (Mw) of the amorphous polyester resin (1) obtained through the molecular weight measurement (in terms of polystyrene) by gel permeation chromatography (GPC) is 15,000, and the number average molecular weight (Mn) is 6,800.

In addition, when the amorphous polyester resin (1) is measured by a differential scanning calorimeter (DSC), a definite peak is not shown, but a stepwise change in the heat absorption amount is observed. The glass transition temperature, that is a middle point of the stepwise change in the heat absorption amount, is 62° C.

3,000 parts of the obtained amorphous polyester resin (1), 10,000 parts of ion exchange water, and 90 parts of a surfactant dodecyl benzene sodium sulfonate are put into an emulsification tank of a high-temperature and high-pressure emulsification device (Cavitron CD1010, slit: 0.4 mm), and then heated and melted at 130° C. Thereafter, the obtained material is dispersed for 30 minutes with 10,000 rotations at 110° C. with a flow rate of 3 L/m, and is made to pass through a cooling tank to collect an amorphous resin particle dispersion (high-temperature and high-pressure emulsification device (Cavitron CD1010, slit: 0.4 mm)), thereby obtaining an amorphous resin particle dispersion (1a).

The volume average particle diameter D50v of the resin particles contained in the obtained amorphous resin particle dispersion (1a) is 0.3 μm, and the standard deviation is 1.2.

Preparation of Crystalline Polyester Resin (2) and Crystalline Resin Particle Dispersion (2a)

| | |
|---|---|
| 1,4-butanediol (manufactured by Wako Pure Chemical Industries, Ltd.) | 293 parts |
| dodecane dicarboxylic acid (manufactured by Wako Pure Chemical Industries, Ltd.) | 750 parts |
| catalyst (dibutyltin oxide) | 0.3 part |

The above components are put into a heat-dried three-necked flask, and then the air in the container is put under an inert atmosphere with nitrogen gas by a decompression operation. The components are stirred for 2 hours at 180° C. by mechanical stirring. Thereafter, the temperature is gradually increased to 230° C. under the reduced pressure and the stirring is performed for 5 hours. When the obtained material becomes viscous, air cooling is performed to stop the reaction, and thus a crystalline polyester resin (2) is synthesized.

The weight average molecular weight (Mw) of the crystalline polyester resin (2) obtained through the molecular weight measurement (in terms of polystyrene) by gel permeation chromatography (GPC) is 18,000.

In addition, when the melting temperature (Tm) of the crystalline polyester resin (2) is measured using a differential scanning calorimeter (DSC) by the above-described measurement method, a definite peak is shown, and the temperature of the peak top is 70° C.

A crystalline resin particle dispersion (2a) is prepared under the same conditions as for the resin particle dispersion (1a), except that the crystalline polyester resin (2) is used. The volume average particle diameter D50v of the particles contained in the obtained dispersion is 0.25 μm, and the standard deviation is 1.3.

Preparation of Colorant Dispersion (1)

| | |
|---|---|
| phthalocyanine pigment (manufactured by Dainichiseika Color & Chemicals Mfg. Co., Ltd., PVFASTBLUE) | 25 parts |
| anionic surfactant (manufactured by Dai-Ichi Kogyo Seiyaku Co., Ltd., Neogen RK) | 2 parts |
| ion exchange water | 125 parts |

The above components are mixed and dissolved, and then dispersed by a homogenizer (manufactured by IKA-Werke GmbH & Co. KG., Ultra Turrax), thereby obtaining a colorant dispersion (1).

Preparation of Release Agent Particle Dispersion (1)

| | |
|---|---|
| Fischer Tropsch wax (weight average molecular weight = 800) | 100 parts |

-continued

| | |
|---|---|
| anionic surfactant (manufactured by NOF Corporation, New Rex R) | 2 parts |
| ion exchange water | 300 parts |

The above components are mixed and dissolved, and then dispersed by a homogenizer (manufactured by IKA-Werke GmbH & Co. KG., Ultra Turrax). Then, a dispersion treatment is performed by a pressure discharge-type homogenizer, thereby obtaining a release agent particle dispersion (1).

Preparation of Inorganic Particle Dispersion (1)

| | |
|---|---|
| hydrophobic silica (manufactured by Nippon Aerosil Co., Ltd., RX200) | 100 parts |
| anionic surfactant (manufactured by NOF Corporation, New Rex R) | 2 parts |
| ion exchange water | 1000 parts |

The above components are mixed and dissolved, dispersed by a homogenizer (manufactured by IKA-Werke GmbH & Co. KG., Ultra Turrax), and then dispersed by an ultrasonic homogenizer (RUS-600CCVP, manufactured by Nippon Seiki Co., Ltd.) for 200 passes, thereby obtaining an inorganic particle dispersion (1).

Preparation of Toner (1)

| | |
|---|---|
| amorphous resin particle dispersion (1a) | 145 parts |
| crystalline resin particle dispersion (2a) | 30 parts |
| colorant dispersion (1) | 42 parts |
| release agent particle dispersion (1) | 36 parts |
| inorganic particle dispersion (1) | 10 parts |
| aluminum sulfate (manufactured by Wako Pure Chemical Industries, Ltd.) | 0.5 part |
| ion exchange water | 300 parts |

The above components are accommodated in a round stainless steel flask, adjusted to pH 2.7, dispersed using a homogenizer (manufactured by IKA-Werke GmbH & Co. KG., Ultra Turrax T50), and then heated to 45° C. under stirring in a heating oil bath. When the obtained material is kept at 48° C. for 120 minutes and then observed by an optical microscope, it is confirmed that aggregated particles having an average particle diameter of 5.6 μm are formed.

After further heating and stirring for 30 minutes at 48° C., it is confirmed by observation using an optical microscope that aggregated particles having an average particle diameter of 6.5 μm are formed. The pH of the aggregated particle dispersion is 3.2. Next, a 1 N sodium hydroxide aqueous solution is gently added thereto to adjust the pH to 8.0, and then the obtained material is heated to 90° C. under stirring and kept for 3 hours. Thereafter, the reaction product is filtered, washed with ion exchange water, and then dried using a vacuum dryer to obtain toner particles (1).

The volume average particle diameter D50v of the obtained toner particles (1) is 6.5 μm. 1 part of gas-phase method silica (manufactured by Nippon Aerosil Co., Ltd., R972) is mixed and externally added with respect to 100 parts of the toner particles by a Henschel mixer, and thus a toner (1) is obtained.

When the SP value of the amorphous polyester resin of the toner (1) is obtained by the above-described method, the SP value is 9.0.

Manufacturing of Toner (2)

A toner (2) is manufactured in the same manner as in the case of the toner (1), except that paraffin wax (weight average molecular weight=800) is used as a release agent.

Preparation of Liquid Developer

Preparation of Liquid Developer (A1-1)

The toner (1) obtained as described above and dimethyl silicone oil (manufactured by Shin-Etsu Chemical Co., Ltd., KF-96L-2cs) are mixed in a glass bottle, thereby obtaining a liquid developer (A1-1) having a toner concentration of 10%.

Preparation of Liquid Developer (A1-2)

The toner (1) obtained as described above and dimethyl silicone oil (manufactured by Shin-Etsu Chemical Co., Ltd., KF-96-10cs) are mixed in a glass bottle, thereby obtaining a liquid developer (A1-2) having a toner concentration of 10%.

Preparation of Liquid Developer (A1-3)

The toner (1) obtained as described above and dimethyl silicone oil (manufactured by Shin-Etsu Chemical Co., Ltd., KF-96-20cs) are mixed in a glass bottle, thereby obtaining a liquid developer (A1-3) having a toner concentration of 10%.

Preparation of Liquid Developer (A2)

The toner (1) obtained as described above and ethylene glycol (manufactured by Wako Pure Chemical Industries, Ltd.) are mixed in a glass bottle, thereby obtaining a liquid developer (A2) having a toner concentration of 10%.

Preparation of Liquid Developer (A3)

The toner (2) obtained as described above and dimethyl silicone oil (manufactured by Shin-Etsu Chemical Co., Ltd., KF-96-20cs) are mixed in a glass bottle, thereby obtaining a liquid developer (A3) having a toner concentration of 10%.

Preparation of Liquid Developer (B0)

The toner (1) obtained as described above and linseed oil (manufactured by Wako Pure Chemical Industries, Ltd.) are mixed in a glass bottle, thereby obtaining a liquid developer (B0) having a toner concentration of 10%.

Preparation of Liquid Developer (B1-1)

The toner (1) obtained as described above and liquid paraffin oil (manufactured by Matsumura Oil Co., Ltd., Moresco White P40, flash point: 130° C.) are mixed in a glass bottle, thereby obtaining a liquid developer (B1-1) having a toner concentration of 10%.

Preparation of Liquid Developer (B1-2)

The toner (1) obtained as described above and liquid paraffin oil (manufactured by Matsumura Oil Co., Ltd., Moresco White MT-30P, flash point: 130° C.) are mixed in a glass bottle, thereby obtaining a liquid developer (B1-2) having a toner concentration of 10%.

Preparation of Comparative Liquid Developer (B2)

The toner (1) obtained as described above and cyclohexane (manufactured by Wako Pure Chemical Industries, Ltd.) are mixed in a glass bottle, thereby obtaining a comparative liquid developer (B2) having a toner concentration of 10%.

Preparation of Comparative Liquid Developer (B3)

The toner (1) obtained as described above and toluene (manufactured by Wako Pure Chemical Industries, Ltd.) are mixed in a glass bottle, thereby obtaining a comparative liquid developer (B3) having a toner concentration of 10%.

Preparation of Comparative Liquid Developer (B4)

The toner (1) obtained as described above and tetrahydrofuran (manufactured by Wako Pure Chemical Industries, Ltd.) are mixed in a glass bottle, thereby obtaining a comparative liquid developer (B4) having a toner concentration of 10%.

Preparation of Comparative Liquid Developer (B5)

The toner (1) obtained as described above and acetone (manufactured by Wako Pure Chemical Industries, Ltd.) are mixed in a glass bottle, thereby obtaining a comparative liquid developer (B5) having a toner concentration of 10%.

Preparation of Comparative Liquid Developer (B6)

The toner (1) obtained as described above and water are mixed in a glass bottle, thereby obtaining a comparative liquid developer (B6) having a toner concentration of 10%.

aggregated: a case in which coarse particles are observed under visual observation increase in size of aggregates: a case in which coarse particles increase in size under visual observation

TABLE 1

| | Test Example I-1 | Test Example I-2 | Test Example I-3 | Comparative Test Example I-1 | Comparative Test Example I-2 | Comparative Test Example I-3 | Comparative Test Example I-4 | Comparative Test Example I-5 | Comparative Test Example I-6 | Comparative Test Example I-7 | Test Example I-4 | Comparative Test Example I-8 |
|---|---|---|---|---|---|---|---|---|---|---|---|---|
| Developer No. | (A1-1) | (A1-2) | (A1-3) | (B0) | (B1-1) | (B1-2) | (B2) | (B3) | (B4) | (B5) | (A2) | (B6) |
| Carrier Liquid | Dimethyl Silicone KF-96L-2cs | KF-96-10cs | KF-96-20cs | Linseed Oil | Liquid Paraffin P40 | MT-30P | Cyclohexane | Toluene | Tetrahydrofuran | Acetone | Ethylene Glycol | Water |
| SP Value of Carrier Liquid [literature data] | 7.2 | 7.2 | 7.2 | 8.3 | 7.9 | 7.9 | 8.2 | 8.8 | 9.1 | 9.9 | 14.6 | 23.4 |
| ΔSP (tc) | 1.8 | 1.8 | 1.8 | 0.7 | 1.1 | 1.1 | 0.8 | 0.2 | 0.1 | 0.9 | 5.6 | 12.4 |
| Toner Dispersibility | Dispersed | Dispersed | Dispersed | Aggregated | Dispersed | Dispersed | Aggregated | Completely Melted | Completely Melted | Aggregated | Dispersed | Separated |
| Toner Dispersibility after Heating under Stirring | No Change | No Change | No Change | Increase in Size of Aggregates | Aggregated | Aggregated | Increase in Size of Aggregates | No Change | No Change | Increase in Size of Aggregates | No Change | No Change |

The SP values of the respective carrier liquids used in the liquid developers and the comparative liquid developers are obtained by the above-described method. The obtained SP values and differences (ΔSP (tc)) between the SP values the amorphous polyester resin of the toner (1) and the carrier liquid are shown in the following Table 1.

Evaluation Test (I)

Evaluation of Toner Dispersibility in Carrier Liquid

Test Examples I-1 to I-4 and Comparative Test Examples I-1 to I-8

As for the liquid developers and the comparative liquid developers obtained as described above, dispersibility of the toner (1) is visually evaluated in accordance with the following evaluation standards. This evaluation is performed after the toner and the liquid are mixed and left for 1 hour at room temperature (23° C.). The results are shown in the following Table 1.

dispersed: a state in which toner particles are uniformly dispersed under visual and magnified observation completely melted: a state in which toner particles are not observed under visual and magnified observation aggregated: a state in which coarse particles are observed under visual observation separated: a state in which toner particles are completely separated from the liquid under visual observation After the evaluation of the dispersibility of the toner (1), the dispersibility of the toner (1) is visually evaluated after being stored for 2 hours under an environment of 60° C. (62° C. (glass transition temperature of the amorphous polyester resin (1))-2° C.) in accordance with the following evaluation standards.

no change: a case in which there is no change from the dispersibility before storage From the above results, it is found that in the test examples, there is no change in toner dispersibility after heating and stirring, and thus document offset does not easily occur under an environment of a temperature lower than the glass transition temperature of the binder resin of the toner, as compared with the comparative test examples I-1 to I-7 in which ΔSP (tc) is small.

In addition, it is found that in the test examples, toner dispersibility is secured, and thus a function as a liquid developer is achieved, as compared with the comparative test example I-8 in which the difference (ΔSP (tc)) between the SP values of the amorphous polyester resin of the toner (1) and the carrier liquid is large.

Evaluation Test (II)

Evaluation of Elution Ratio of Release Agent in Carrier Liquid

Test Examples II-1 and II-2 and Comparative Test Examples II-1 to II-6

The elution ratios of the release agents used in the toner (1) and (2) in the carrier liquid are examined. The results thereof are shown in Table 2. The details of the carrier liquid are the same as in the above description of the manufacturing of the liquid developer.

Specifically, 10 g of release agent particles having an average particle diameter of 3 mm are dipped in 90 g of a carrier liquid of the type according to Table 2, and allowed to stand still for 6 hours under an environment of 60° C. (62° C. (glass transition temperature of the amorphous polyester resin (1))-2° C.). After the still standing, the liquid and the release agent particles (solid content) in the carrier liquid are separated using a sieve immediately after extraction of the carrier liquid from this environment. The mass of the separated release agent particles (solid content) is measured, and through the following expression, the elution ratio of the release agent in the carrier liquid is calculated.

elution ratio of release agent=(release agent particles separated from carrier liquid/mass of release agent particles before dipping in carrier liquid)×100 Expression:

TABLE 2

| | Comparative Test Example IIA-1 | Comparative Test Example IIA-2 | Comparative Test Example IIA-3 | Comparative Test Example IIA-4 | Test Example IIA-1 | Comparative Test Example IIA-5 | Test Example IIA-2 |
|---|---|---|---|---|---|---|---|
| Release Agent | | | | Fischer Tropsch Wax | | | |
| Carrier Liquid | Liquid Paraffin | | | Dimethyl Silicone | | Linseed Oil | Ethylene Glycol |
| | P40 | MT-30P | KF-96L-2cs | KF-96-10cs | KF-96-20cs | | |
| Elution Ratio of Release Agent | 18% | 25% | 15% | 8% | 3% | 6% | 4% |
| | Comparative Test Example IIB-1 | Comparative Test Example IIB-2 | Comparative Test Example IIB-3 | Comparative Test Example IIB-4 | Test Example IIB-1 | Comparative Test Example IIB-5 | Test Example IIB-2 |
| Release Agent | | | | Paraffin Wax | | | |
| Carrier Liquid | Liquid Paraffin | | | Dimethyl Silicone | | Linseed Oil | Ethylene Glycol |
| | P40 | MT-30P | KF-96L-2cs | KF-96-10cs | KF-96-20cs | | |
| Elution Ratio of Release Agent | 25% | 30% | 18% | 9% | 4% | 10% | 4% |

From the above results, it is found that in the test examples IIA-1 and IIA-2, the elution ratio of the release agent is less than 5% and the release layer of a fixed image is not easily softened, and thus document offset does not easily occur under an environment of a temperature lower than the glass transition temperature of the binder resin of the toner, as compared with the comparative test examples.

It is found that the same results are obtained also in the test examples IIB-1 and IIB-2.

Evaluation Test (III)

Document Offset Evaluation

Examples III-1 and Comparative Examples III-1 to III-3

Using the liquid developer described in Table 3, a fixed image is formed and the following evaluation is performed. The liquid developer is adjusted to have a toner concentration of 30%.

Specifically, an experimental image forming apparatus for liquid developing (modified machine that is modified so that the fixing device performs fixing in two stages, and a toner image is heated in a non-contact manner by a halogen heater in the first stage and is then heated and pressurized by a pair of fixing rolls in the second stage) is prepared, developer units are filled with respective liquid developers, and an accommodation part is filled with Form Gross N85gsm (manufactured by Oji Paper Co., Ltd.) as recording mediums.

This experimental apparatus performs developing after a toner mass (TMA) and a carrier liquid mass (CMA) at the time of transferring a liquid developer onto a recording medium are adjusted to 3.5 g/m$^2$ and 3.5 g/m$^2$, respectively, and a fixed image is formed on the recording medium at a processing speed of 80 m/min under fixing conditions in which non-contact heating is performed at a first-stage fixing temperature of 80° C. (a surface temperature of the recording medium is 80° C.), and direct heating and pressurization are performed 6 times for 7 ms at a second-stage fixing temperature of 150° C. and a load of 2.7 kg/cm$^2$.

Fixability Evaluation

Fix Level (Crease) Evaluation

The fix level (crease) evaluation is performed as follows.

An image part is folded and a circular cylindrical block is rotated along the folding line part to apply a linear pressure of 300 g/cm$^2$. Thereafter, the image part is unfolded to measure the line width of a stripe image deletion part that is shown in the folding line part by using an optical microscope (manufactured by Keyence Corporation, VHX-1000), and the evaluation is performed with the following standards.

The evaluation standards are as follows.

A+: The line width of the deletion part is less than 0.5 mm.

A: The line width of the deletion part is from 0.5 mm to less than 1 mm.

B: The line width of the deletion part is 1 mm or greater.

Eraser Rubbing Evaluation

The eraser rubbing evaluation is performed as follows.

An eraser (manufactured by Tomboy Pencil Co., Ltd., MONO) is pressed against an image part at a surface pressure of 50 g/cm$^2$ to rub the image twice. Thereafter, the state of the eraser is evaluated with the following standards.

The evaluation standards are as follows.

A+: The color of the image is not transferred to the eraser.

A: The color of the image is slightly transferred to the eraser.

B: The color of the image is definitely transferred to the eraser.

Document Offset

The document offset evaluation is performed as follows.

Regarding document offset with respect to a fixed image (stated as "with respect to fixed image"), fixed image parts are opposed to and superposed on each other, a load of 80 g/cm$^2$ in terms of surface pressure is applied thereto, and the fixed image parts are allowed to stand still for 1 day under an environment of a temperature of 60° C. and a humidity of 50%. The superposed image is taken out from the above environment to evaluate the states of the fixed image parts after opening with the following standards.

Regarding document offset with respect to a recording medium (stated as "with respect to recording medium"), a fixed image and a recording medium are opposed to and superposed on each other, a load of 80 g/cm$^2$ in terms of surface pressure is applied thereto, and the fixed image and the recording medium are allowed to stand still for 1 day under an environment of a temperature of 60° C. and a humidity of 50%. The superposed image is taken out from the above environment to evaluate the states of the fixed image part and the recording medium after opening with the following standards.

The evaluation standards are as follows.

Evaluation Standards of Document Offset with Respect to Fixed Image

A+: The fixed image part is not transferred to the other fixed image.

A: The fixed image part is slightly transferred to the other fixed image.

B: The fixed image part is definitely transferred to the other fixed image.

Evaluation Standards of Document Offset with Respect to Recording Medium

A+: The fixed image part is not transferred to the recording medium, or the recording medium is not transferred to the fixed image part.

A: The fixed image part is slightly transferred to the recording medium, or the recording medium is slightly transferred to the fixed image part.

B: The fixed image part is definitely transferred to the recording medium, or the recording medium is definitely transferred to the fixed image part.

TABLE 3

| | Developer No. | ΔSP (tc) | Elution Ratio of Release Agent | Carrier Liquid | Fixability: Fix Level (crease) | Fixability: Eraser Rubbing | Document Offset: With Respect to Fixed Image | Document Offset: With Respect to Recording Medium |
|---|---|---|---|---|---|---|---|---|
| Comparative Example III-1 | (A1-1) | 1.8 | 15% | Dimethyl Silicone KF-96L-2cs | A+ | A | A | B |
| Example III-1 | (A1-3) | 1.8 | 3% | KF-96-20cs | A+ | A | A+ | A |
| Comparative Example III-2 | (B0) | 0.7 | 6% | Linseed Oil | A | B | B | B |
| Comparative Example III-3 | (B1-1) | 1.1 | 25% | Liquid Paraffin P40 | A | A | B | B |

From the above results, it is found that in the examples, good results are obtained in the fixability evaluation and in the document offset evaluation, as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

a toner that contains a binder resin and a release agent; and a carrier liquid that has a difference (ΔSP (tc)) in SP value from the binder resin of from 1.5 to 7.0, wherein the release agent is not eluted in the carrier liquid at a temperature lower than a glass transition temperature of the binder resin.

2. The liquid developer according to claim 1, wherein the difference (ΔSP (tc)) between the SP values of the binder resin and the carrier liquid of the toner is from 1.5 to 6.

3. The liquid developer according to claim 1, wherein the difference (ΔSP (tc)) between the SP values of the binder resin and the carrier liquid of the toner is from 1.7 to 5.7.

4. The liquid developer according to claim 1, wherein the release agent has an elution ratio of less than 5% by weight with respect to the carrier liquid.

5. The liquid developer according to claim 1, wherein the binder resin is a polyester resin.

6. The liquid developer according to claim 1, wherein the carrier liquid is selected from silicone oil and polyol.

7. The liquid developer according to claim 1, wherein the carrier liquid is silicone oil.

8. An image forming apparatus comprising:

an electrostatic latent image holding member;

a charging device that charges a surface of the electrostatic latent image holding member;

a latent image forming device that forms an electrostatic latent image on the surface of the electrostatic latent image holding member;

a developing device that contains the liquid developer according to claim 1 and develops the electrostatic latent image formed on the surface of the electrostatic latent image holding member with the liquid developer to form a toner image;

a transfer device that transfers the toner image onto a recording medium; and a fixing device that fixes the toner image to the recording medium by heating and pressurizing the toner image on the recording medium.

9. An image forming method comprising:

charging a surface of an electrostatic latent image holding member;

forming an electrostatic latent image on the surface of the electrostatic latent image holding member;

developing the electrostatic latent image formed on the surface of the electrostatic latent image holding member with the liquid developer according to claim 1 to form a toner image;

transferring the toner image onto a recording medium; and fixing the toner image to the recording medium by heating and pressurizing the toner image on the recording medium.

10. A liquid developer cartridge that accommodates the liquid developer according to claim 1 and is detachable from an image forming apparatus.

11. A process cartridge that includes a developing device that accommodates the liquid developer according to claim 1 and develops an electrostatic latent image formed on a surface of an electrostatic latent image holding member with the liquid developer to form a toner image, and is detachable from an image forming apparatus.

* * * * *